US005108410A

United States Patent [19]

Iwasaki et al.

[11] Patent Number: 5,108,410

[45] Date of Patent: Apr. 28, 1992

[54] DEPILATING DEVICE

[75] Inventors: Juzaemon Iwasaki, Nagahama; Masao Tanahashi, Hikone, both of Japan

[73] Assignee: Matsushita Electric Works, Ltd., Osaka, Japan

[21] Appl. No.: 705,686

[22] Filed: May 24, 1991

[30] Foreign Application Priority Data

May 28, 1990 [JP] Japan ..... 2-137752
Feb. 2, 1991 [JP] Japan ..... 3-26105

[51] Int. Cl.[5] ..... A61B 17/50
[52] U.S. Cl. ..... 606/133
[58] Field of Search ..... 606/133, 131, 134; 17/11.1 R

[56] References Cited

U.S. PATENT DOCUMENTS

| | | | |
|---|---|---|---|
| 2,900,561 | 8/1959 | Schnell | 606/133 X |
| 4,830,004 | 5/1989 | Alazet | 606/133 |
| 4,960,422 | 10/1990 | Demeester | 606/133 |
| 5,032,126 | 7/1991 | Cleyet et al. | 606/133 |
| 5,041,123 | 8/1991 | Oliveau et al. | 606/133 |

FOREIGN PATENT DOCUMENTS

| | | | |
|---|---|---|---|
| 147285 | 7/1985 | European Pat. Off. | 606/133 |

*Primary Examiner*—Peter A. Aschenbrenner

*Attorney, Agent, or Firm*—Armstrong, Nikaido, Marmelstein, Kubovcik & Murray

[57] ABSTRACT

A depilating device removes hairs from the skin of a user and includes a carrier mounting a series of movable and fixed pinching plates arranged along a carrier axis in an alternating relation and in a closely adjacent relation to form small clearances between the adjacent movable and fixed pinching plates for entrapping hairs therebetween. A drive means is connected to drive the carrier to move the movable and fixed plates about the carrier axis. The movable plates are operatively connected to a shuttle means which is movable together with the carrier about the carrier axis but are shiftable therealong relative to the carrier so as to displace the movable plates along the carrier axis to repeat clamping the hairs between the adjacent pairs of the movable and fixed plates as the carrier moves about the carrier axis, whereby plucking the hairs from the skin. Also included in the device is a positive-return cam means which is connected to the shuttle means and is caused to rotate relative to the shuttle means about a cam axis parallel with the carrier axis so as to shift it along the carrier axis for displacing the movable plates relative to the fixed pinching plates. The positive-return cam means is connected to the carrier through the shuttle means and the movable plates in such a mutual supporting relation as to restrict the movements of the positive-return cam means and the carrier relative to each other in the direction parallel to the carrier axis.

10 Claims, 32 Drawing Sheets

DEPILATING DEVICE

BACKGROUND OF THE INVENTION

1. Field of the Invention

The present invention is directed to a depilating device for removing superfluous hairs from the skin for aesthetic reasons or the like.

2. Description of the Prior Art

Depilating devices are known, for example, in Japanese utility model publication (KOKOKU) No. 57-54725 and in European Patent Specification No. 0,328,426. The Japanese publication discloses using a pair of rollers which are in rolling contact with each other to catch the hairs between the rollers and pull the hairs out of the skin while rotating the rollers. This device is, however, capable of plucking only a small amount of the hairs at a time and is therefore rather ineffective. The European patent discloses the use of a series of pinching disks supported on a rotating shaft. Each alternate disk is connected to levers to be reciprocated thereby along the axis of the shaft as the disks rotate about the axis in such a manner that each alternate disk is caused to repeat clamping the hairs between the adjacent disks and releasing the same during the rotary movement of the disks, thereby plucking the hairs from the skin periodically. The levers are interconnected through each alternate disk to the shaft to be rotatable therewith about the shaft axis and is also linked to a rotating cam with its one end urged by a spring against a cam surface such that the levers are caused to reciprocate along the shaft axis by the cam against the spring bias. With this arrangement, a spring load is constantly applied to the contacting surface between the cam and the one end of the lever, which incurs a relatively large rotational load and therefore requires a powerful motor to rotate the shaft and reciprocate the levers as compensating for the relatively large rotational load. Further, since the disks are displaced by the levers under the bias of the spring, the disks are brought into contacting engagement with the adjacent disks with a loud impact noise at the time to clamping the hairs therebetween. Consequently, in spite of that the device is capable of plucking a large amount of the hairs with the use of a number of the disks arranged along the shaft axis, the device suffers from problems that it necessitates the motor of relatively great power and therefore of large configuration as well as it produces high level noise during the plucking operation.

SUMMARY OF THE INVENTION

The above problems have been eliminated in an improved depilating device of the present invention. The depilating device in accordance with the present invention comprises a carrier mounting a series of first and second pinching plates which are arranged along an axis of the carrier in an alternating relation and in a closely adjacent relation to define small clearance between the adjacent first and second pinching plates for entrapping hairs therebetween. A drive means is connected to drive the carrier for moving the first and second pinching plates together about the carrier axis. Also included in the device is a shuttle means which is operatively connected to at least ones of the first and second pinching plates and is movable together with the carrier about the carrier axis. The shuttle means is shiftable along the carrier axis relative to the carrier to displace the first pinching plates relative to the second pinching plates along the carrier axis in order to repeat clamping the hairs between the adjacent first and second pinching plates and releasing the same during the movement of the first and second pinching plates about the carrier axis, thereby plucking the hairs from the skin and discharging the same out of the first and second pinching plates. A positive-return cam means is connected to the shuttle means and is caused to rotate relative to the shuttle means about a cam axis parallel with the carrier axis so as to shift the shuttle means along the carrier axis for displacing the first pinching plates relative to the second pinching plates. The positive-return cam means is linked to the carrier through the shuttle means and the first pinching plates in such a mutual supporting relation as to restrict the movement of the positive-return cam means and the carrier relative to each other in the direction parallel to the carrier axis. With the use of the positive-return cam, the shuttle means can reciprocate in the axial direction of the shaft in an exact correspondence to the cam configuration without requiring any other return spring or the like and therefore free from any spring load which would be otherwise applied to the shuttle means and the carrier, thereby enabling reducing the power requirement to the drive means and to reduce the contacting noise between the adjacent pinching plates. Further, because of that the positive-return cam means is linked to the carrier through the shuttle means in such a mutual supporting relation as to restrict the movement of the positive-return cam means and the carrier relative to each other in the direction parallel to the carrier axis, these parts can be retained in a position within a housing of the depilating device with respect to the axial direction of the carrier and can be therefore well prevented from vibrating in the axial direction. Thus, the carrier and the cam means can be supported in the housing without causing intense collision against individual supporting structures in the housing, thereby greatly reducing the operation noise.

Accordingly, it is a primary object of the present invention to provide an improved depilating device which is capable of plucking the hairs efficiently with less power requirement and with greatly reduced operation noise.

In one version of the present invention, the carrier is in the form of a rotary shaft driven by the drive means to rotate about the axis together with the first and second pinching plates; and the shuttle means comprises a set of levers spaced circumferentially about the rotary shaft and extending in parallel therewith. The levers are rotatable together with the rotary shaft and operatively connected to the positive-return cam means to be shiftable along the rotary shaft in response to the rotary movement of the rotary shaft relative to the cam means for reciprocating at least ones of the first and second pinching plates along the rotary shaft. In another version, the carrier is in the form of a barrel driven by the drive means to oscillate about an axis of the barrel defining the carrier axis together with the first and second pinching plates within a limited angular range. The shuttle means comprises a pair of levers extending along the barrel axis and connected to at least the first pinching plates. The levers are capable of oscillating together with the barrel and operatively connected to the positive-return cam means so as to be shiftable along the barrel axis in response to the oscillatory movement of the barrel relative to the cam means for reciprocating at least ones of the first and second pinching plates along the barrel axis.

In either of the two versions, each first pinching plate is connected to the corresponding lever to be displaced relative to the adjacent the second pinching plate in such a manner as to move one radial end of each first pinching plate closer to the adjacent second pinching plate than the opposite radial end of each first pinching plate so that the first pinching plate swings with respect to a plane normal to the carrier axis about a fulcrum point located on the opposite side of the one radial end from the carrier axis. Each first pinching plate is connected to the corresponding lever at a portion intermediate between the one radial end and the carrier axis so that said first pinching plate swings by a force applied to that intermediate portion from the cam means. With this structure of applying the force to the first pinching plate at a force point intermediate between the one radial action end of the first pinching plate to be brought into contact with the adjacent second pinching plate and the carrier axis about the fulcrum point located on the opposite side of the force point and the action end from the carrier axis, it is possible to displace the action end of the first pinching plate sufficiently for clamping the hairs between the adjacent first and second pinching plates with the force of less intensity applied to the force point than in the case where the fulcrum point is on the carrier axis or on the same side of the focal point from the carrier axis. This contributes to reduce the load requirement to the carrier and therefore minimize the operation noise.

It is therefore another object of the present invention to provide an improved depilating device which is capable of reciprocating the first pinching plate relative to the second pinching plate with less power requirement and with reduced noise level.

At least ones of the first and second pinching plates are made of shock-absorbing plates in order to dampen the impact between the first and second pinching plates for further reducing the noise at the time of closing these plates, which is therefore a further object of the present invention.

Preferably, the first and second pinching plates are arranged such that some pairs of first and second pinching plates come into a closed condition of plucking the hairs therebetween in a delayed fashion from the other pairs of said first and second pinching plates as the carrier moves about the carrier axis. In this manner, it is possible to pluck the hairs successively portion by portion so as to reduce the number of hairs to be removed at a time but without failing to pluck the hairs or without reducing the total bulk of the hairs. This is advantageous to dissipating and lessen the pain or stimulus in plucking the hairs, which is therefore a still further object of the present invention.

The depilating device of the present invention may include a trimmer comprising a stationary blade and a movable blade which are in hair shearing engagement along a line parallel to said carrier axis. The stationary blade has an edge projecting beyond a complementary cutting edge of said movable blade for contact with the skin of the user in such a manner as to position the cutting edge of the movable blade away from the skin. With the use of the trimmer, relatively long hairs can be cut to a short length prior to the introduction to the pinching plates so that the pinching plates can clamp the roots of the short hairs without fail for effectively plucking the hairs.

It is therefore a further object of the present invention to provide an improved depilating device which is capable of plucking relatively long hairs with the assistance of the trimmer.

These and still other objects and advantages will become more apparent from the following detailed description of the preferred embodiments of the present invention when taken in conjunction with the attached drawings.

DETAILED DESCRIPTION OF THE EMBODIMENTS

First Embodiment <FIGS. 1 to 15>

Figure 1:
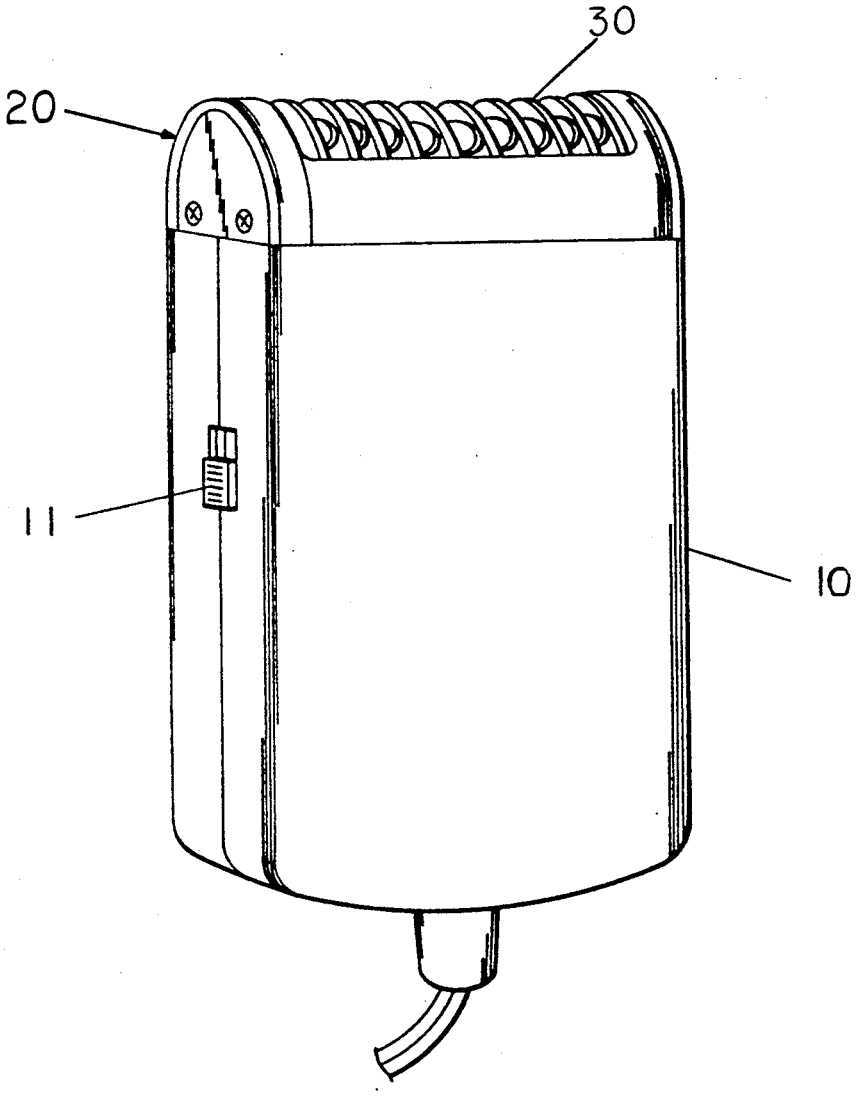
FIG. 1 is a perspective view of a depilating device in accordance with a first embodiment of the present invention.
Figure 2:
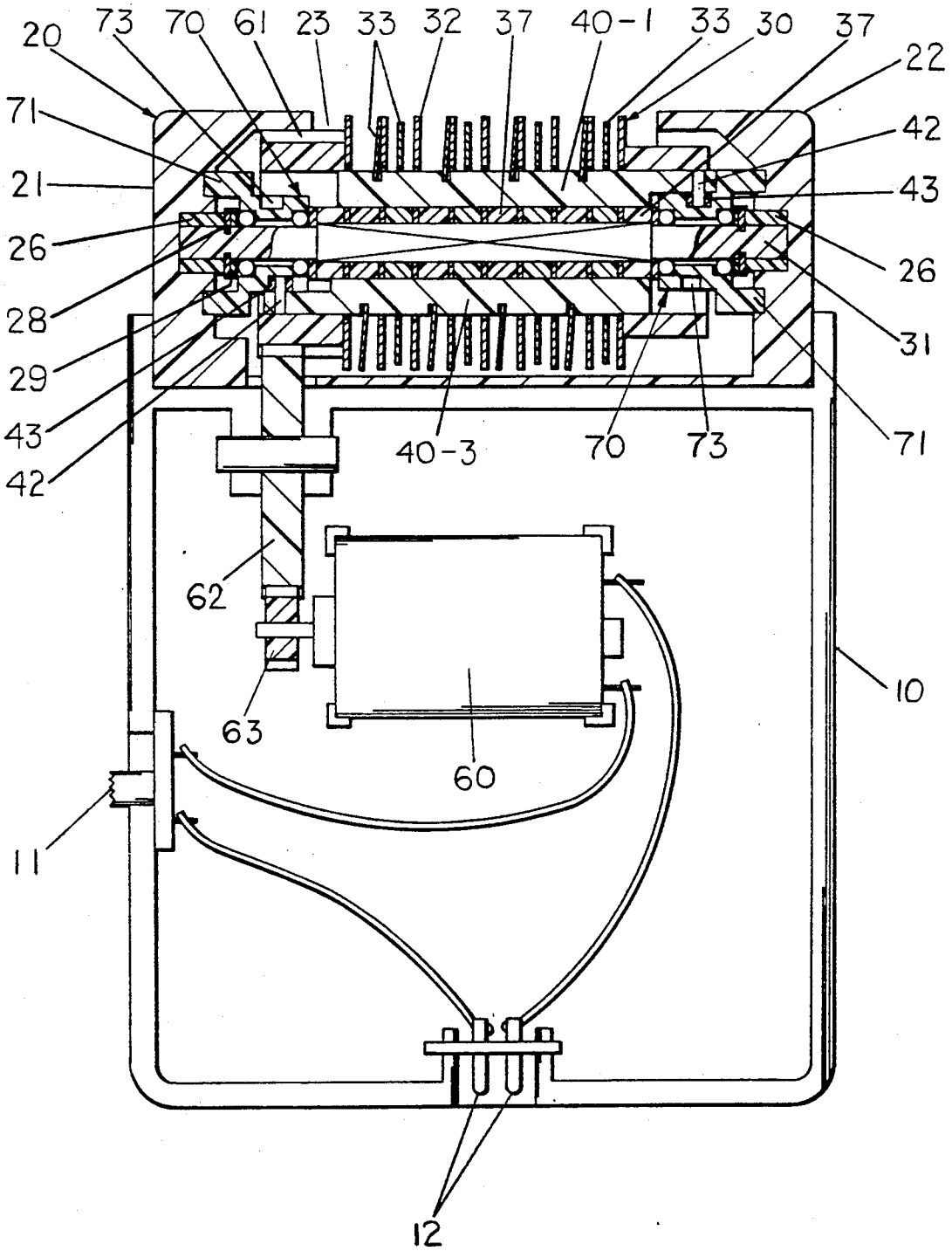
FIG. 2 is a vertical section of the depilating device.
Figure 3:
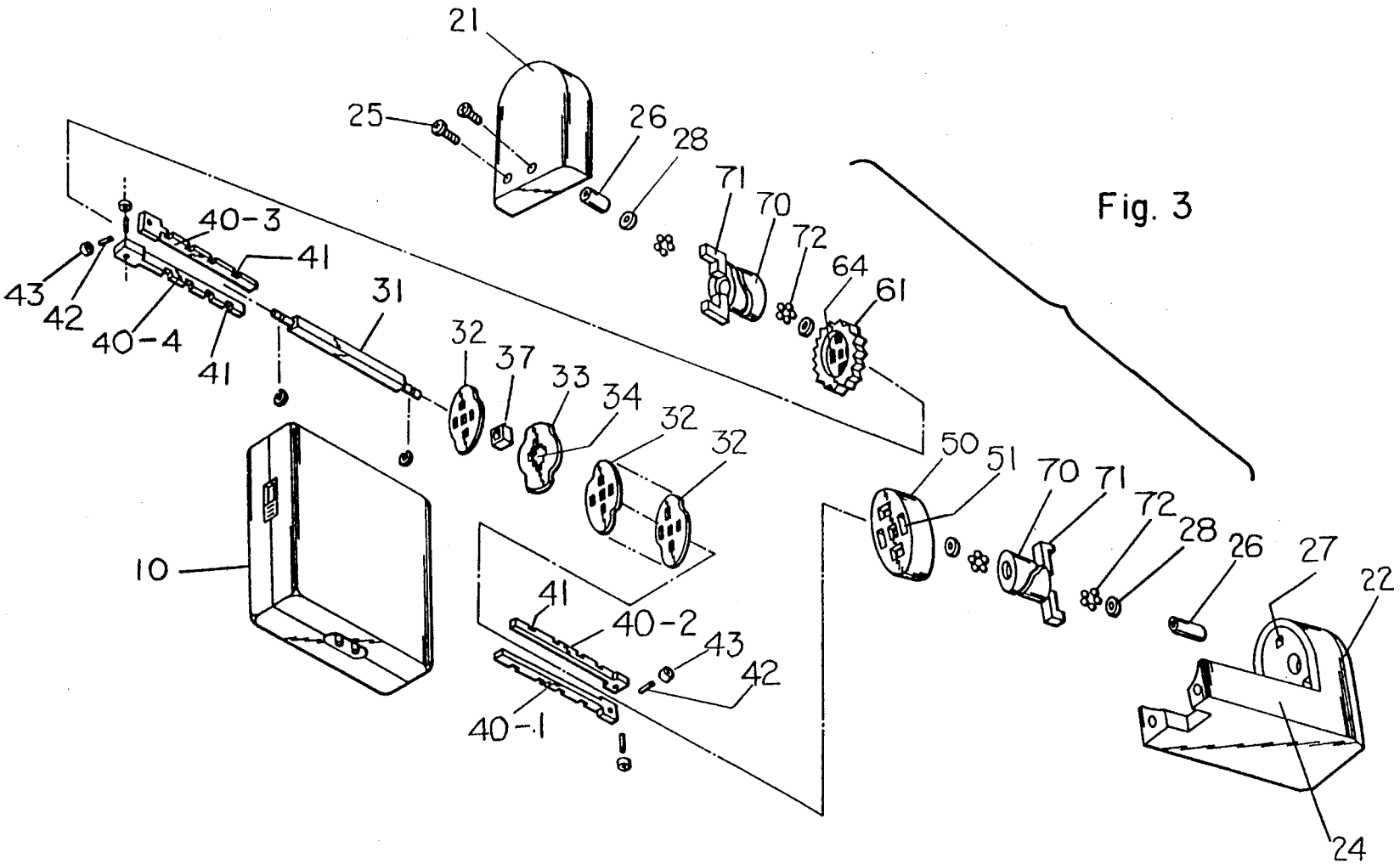
FIG. 3 is an exploded perspective view of the depilating device.

Referring now to FIG. 1, there is shown a depilating device in accordance with a first embodiment of the present invention. The device comprises a housing 10 and a depilator head 20 mounted on the upper end of the housing 10 and supporting therein a plucking assembly 30 for removing the hairs from the skin. As shown in FIGS. 2 and 3, the housing 10 incorporates a motor 60 for driving the plucking assembly 30 and is provided with a power switch 11 for energization and deenergization of the motor 60. A pair of terminal pins 12 is provided in the lower end of the housing 10 for electrical connection to a power source through a cable. The depilating head 20 comprises a pair of end walls 21 and 22 which define therebetween an opening 23 and which are interconnected by means of screws 2S extending through the end wall 21 into an integral base 24 extending horizontally from the end wall 22.

The plucking assembly 30 comprises a rotary shaft 31 extending horizontally between the end walls 21 and 22 with its ends journaled by means of bearings tube 26 fitted respectively in the inner surfaces of the end walls 21 and 22. As shown in FIG. 3, the rotary shaft 31 is shaped to have a square cross-section except for the longitudinal ends received in the bearings tube 26. A reduction gear 61 is fitted on end of the square cross-sectional portion of the shaft 31 to be rotatable together therewith. The gear 61 is in meshing engagement through an intermediate gear 62 supported in the upper portion of the housing 10 with a drive gear 63 On an output shaft of the motor 60 so that the rotor shaft 31 is driven by the motor 60 to rotate in one direction about a horizontal axis. The shaft 31 carries a series of axially spaced fixed and movable pinching plates [hereinafter referred to simply as fixed and movable plates] 32 and 33 both rotatable together with the shaft 31 and exposed into the opening 23 of the head 20. The fixed and movable plates 32 and 33 alternate in the axial direction with the fixed plates 32 on the opposite ends of the shaft 31 such that the fixed plates 32 are fixed in the axial direction and the movable plates 33 is allowed to shift in that direction. The fixed plates 32, each formed in its center with a square hole through which the square portion of the shaft 31 extends snugly to support the fixed plates 32 in a plane perpendicular to the shaft axis and to rotate the same about the shaft axis, are axially spaced at a regular interval to one another by means of square-shaped collar 37 fitted on the shaft 31. The movable plates 33 are each formed in its center with a relatively large square hole 34 in which the collar 37 is loosely engaged such that the movable plates 33 are rotatable together with the shaft 31 and also shiftable in the axial direction in an inclined relation with respect to the shaft axis.

Figure 5A:
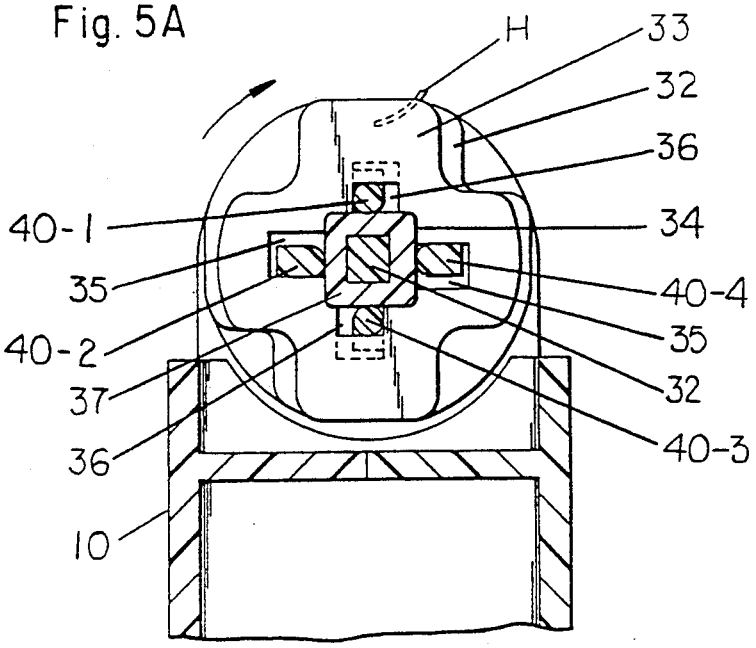
FIGS. 5A to 5D are sectional views taken along lines X—X of FIGS. 4A to 4D, respectively.
Figure 4A:
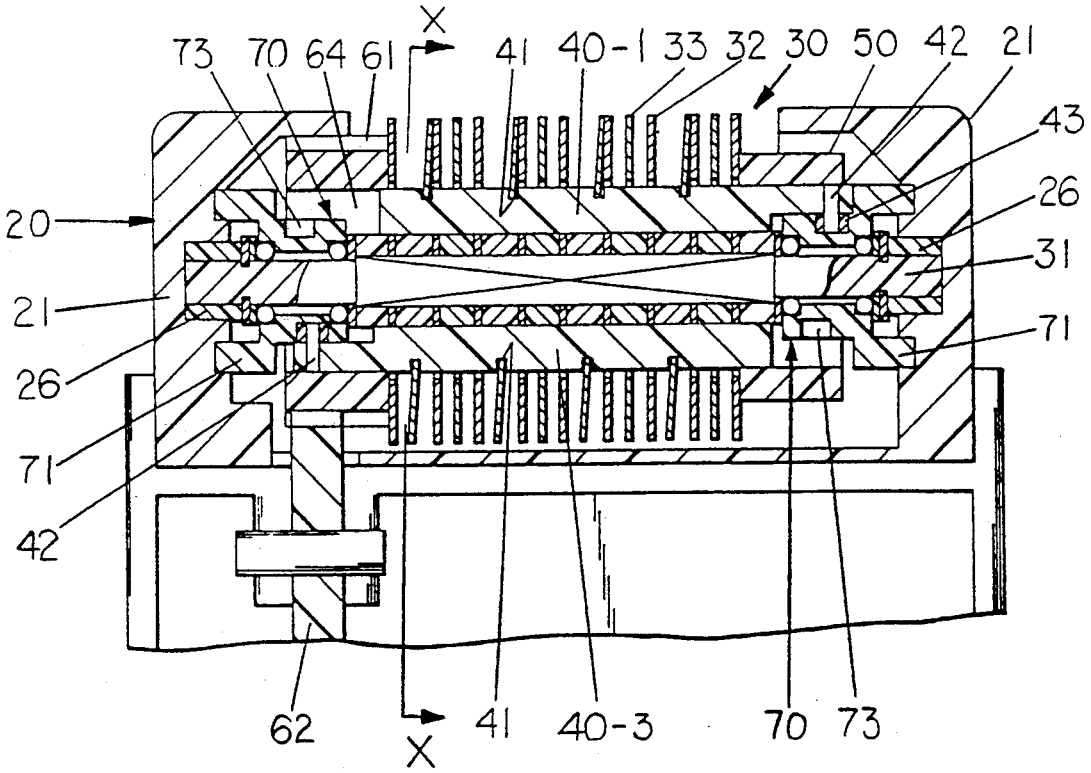
FIGS. 4A to 4D are vertical sections of an upper portion of the depilating device shown respective with different conditions.
Figure 5B:
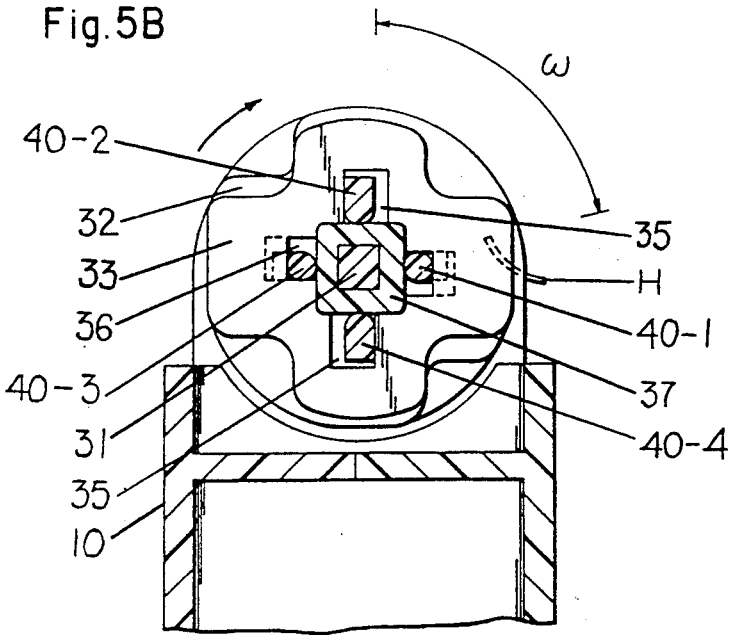
Figure 4B:
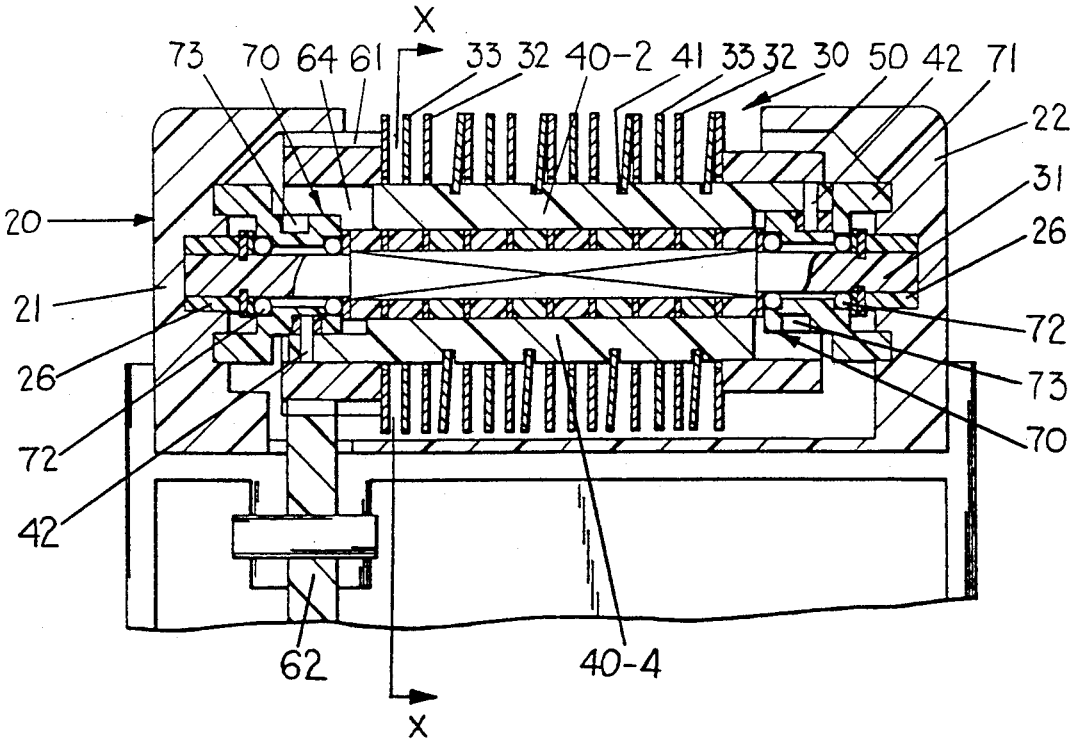

A set of four shuttle levers 40-1 to 40-4 extend in parallel with the shaft 31 and are circumferentially spaced at an angular interval of 90° about the shaft 31. Each lever 40 is supported with its opposite ends slidably received respectively in one of axial bores 64 of the gear 61 and in one of axial bores 51 in a support ring 50 which is fitted on the axial end of the square cross-sectional portion of the shaft 31 to be rotatable together therewith. Each of the levers 40-1 to 40-4 penetrates through the fixed and movable plates 32 and 33 in such a manner as to engage each alternate movable plate 33 for displacing it along the axial direction when the lever reciprocates along the shaft 31 as will be discussed later. To this end, each lever 40 is formed along its length with a plurality of notches 41 for connection with each alternate movable plate 33. As best shown in FIG. 5A, each movable plate 33 is formed with four slots circumferentially spaced by 90° about the center hole 34. Two slots 35 in a diametrically opposed pair extend radially by a greater extent than the other two slots 36 in the other diametrically opposed pair, such that the lever 40 can freely pass through the long slots 35 but engages at the individual notches 41 with the radial outer edges of the short slots 36 so as to displace thus engaged movable plates 33 as the lever is driven to reciprocate along the shaft 31. It is noted at this time that each of the levers 40-1 to 40-4 penetrates loosely through corresponding slots in the fixed plates 32 so as to be allowed to reciprocate independently of the fixed plates 32. The levers 40-1 and 40-3 in one diametrically opposed pair are engaged with the common movable plates 33 in one set, while the levers 40-2 and 40-3 in the other pair are engaged with the common movable plates 33 in the other set, each set comprising a plurality of the movable plates 33 alternating to each other along the shaft 31. Each lever can be easily connected to the movable plates 33 simply by inserting the lever through the short slots 36 and then twisting it by 90° to effect engagement between the notches 41 and the radial outer edges of the corresponding short slots 36.

Each of the levers 40-1 to 40-4 carries at its one end a pin 42 with a roller 43 for connection with one of positive-return cams 70 which are fitted around the opposite ends of the shaft 31 and held stationary with anchor legs 71 of each cam 70 being loosely engaged into corresponding dents 27 in the interior surfaces of the end walls 21 and 22. Ball bearings 72 are provided at the interface between each cam 70 and the round portion of the shaft 31 to permit the shaft 31 to rotate relative to the cam 70 held stationary on the side of the end walls 21 and 22. A washer 28 and a stop ring 29 are disposed between the outer end of each cam 70 and the bearing tube 26. Each cam 70 is in the form of a cylinder cam with a groove 73 in the cylindrical surface for guiding engagement with the roller 43 at the end of the lever 40 such that the lever 40 is driven by the cam 70 to shift along the shaft 31 as the lever rotates together with the shaft 31. In this manner, as the plunking assembly 30 rotates about the shaft axis, the levers 40-1 to 40-2 are driven by the cams 70 to reciprocate for displacing the movable plates 33 against the adjacent fixed plates 32 to repeat closing the one circumferential edge of the movable plate 33 to the corresponding edge of the fixed plate 32, thereby clamping the hairs between the closed plates 32 and 33 and plucking the hairs in the circumferential direction and releasing the same.

The grooves 73 of the cams 70 are configured to be symmetrical with one another and to be spaced by a maximum distance at an upper end immediately below the opening 23 of the head 20 and by a minimum distance at the lower end remote from the opening 23 such that the levers 40 rotating to reach the top end of the assembly 30 are shifted horizontally outwardly and the levers 40 rotating to reach the lower end are shifted horizontally inwardly. Thus, the levers 40 are caused to reciprocate one stroke along the shaft axis per one rotation thereabout. It is noted at this time that the two circumferentially adjacent levers 40-1 and 40-2 [40-3 and 40=4] which are engaged with different movable plates 33 are linked to the common cam 70. In other words, the diametrically opposed levers 40-1 and 40-3 [40-2 and 40-4] engaged with the same movable plates 33 are linked to the different cams 70 such that the movable plates 33 commonly engaged with the two diametrically opposed levers are shifted in the opposite directions between the two adjacent fixed plates 32 per 180° rotation of the levers 40 about the shaft axis. This means that the movable plate 33, which are brought into close edge contact with one of the adjacent fixed plates 32, is shifted to move away therefrom and into close edge contact with the other adjacent fixed plates 32 every after 180° rotation of the shaft 31. That is, each one of the movable plates 33 is brought into close edge contact with the adjacent fixed plates 32 in a delayed fashion per one rotation of the plunking assembly 30 for clamping the hairs entering the opening 23 of the head 20 and plucking the same.

Figure 5C:
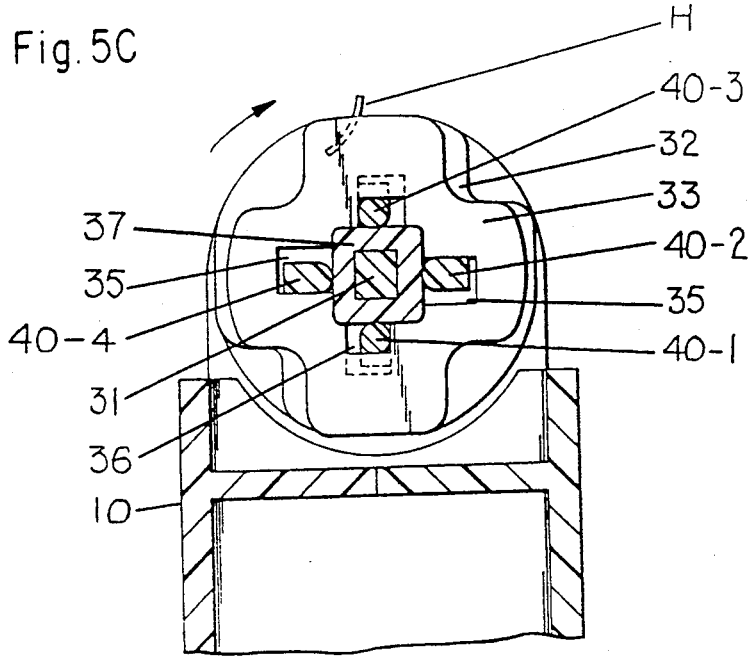
Figure 4C:
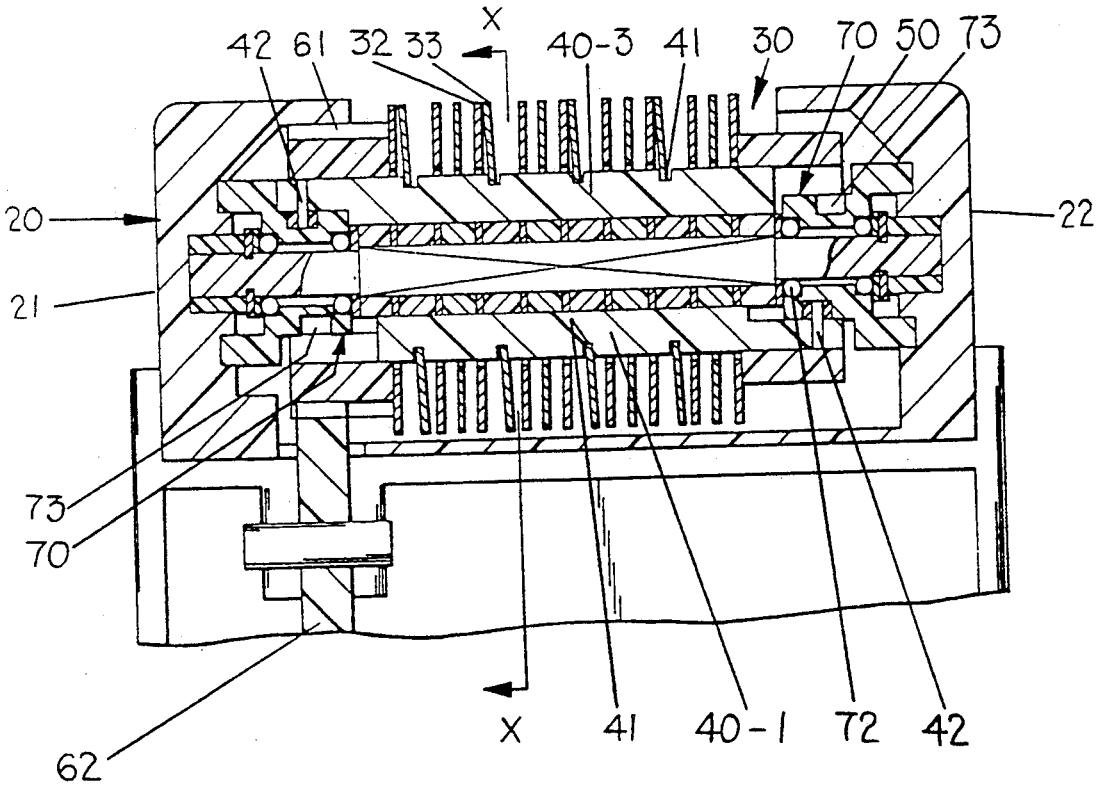
Figure 5D:
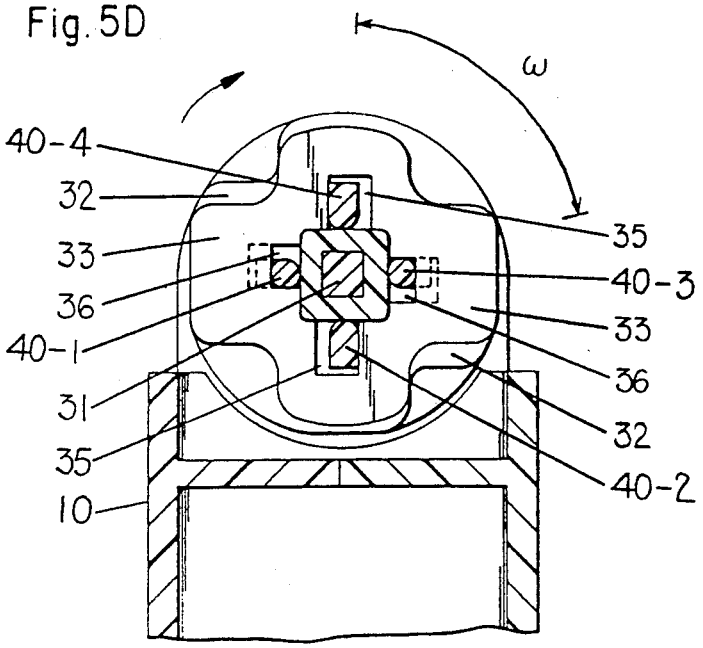
Figure 4D:
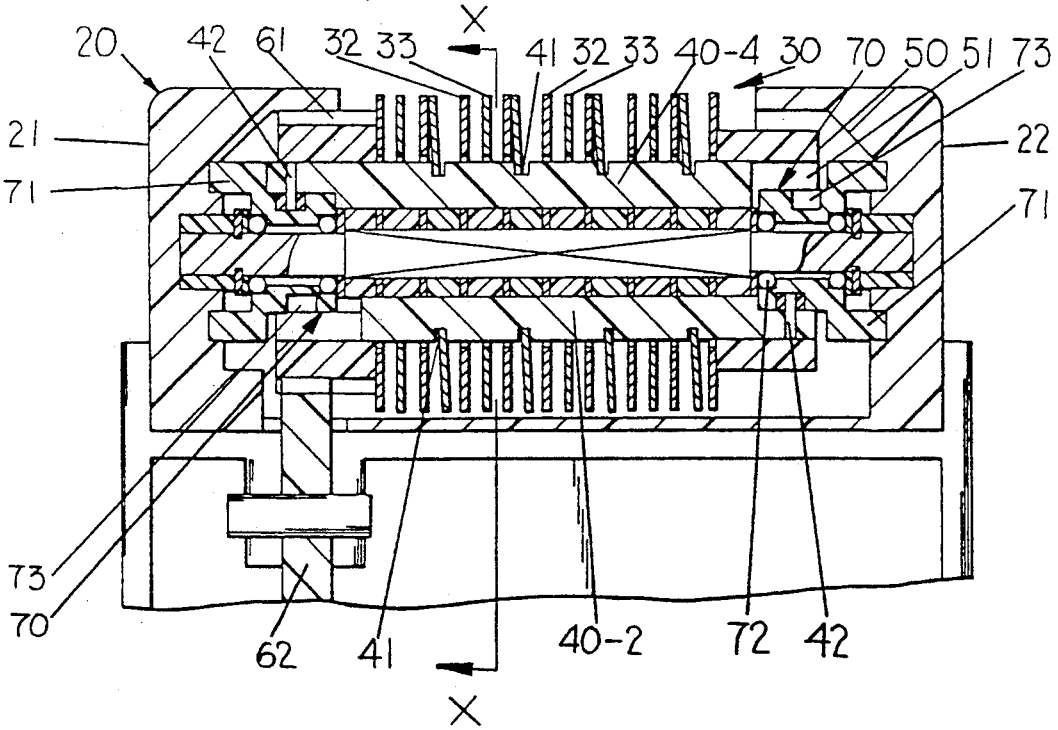

The above operation of the plucking assembly 30 can be easily understood from FIGS. 4A to 4D and 5A to 5D which illustrate one rotation of the plucking assembly in sequence. It is noted that the movable plates 33 are kept in close edge contact with the adjacent fixed plates 32 over an angular range of $\omega$ indicated in FIGS. 5B and 5D and are otherwise spaced away therefrom. Thus, the hairs clamped between the plates 32 and 33 as shown in FIGS. 5A and 5C are plucked from the skin as the plates 32 and 33 rotate within the range in the clockwise direction in FIGS. 5B and 5D. After the plates 32 and 33 rotate further beyond that range, the plucked hairs are released and are flew away by the centrifugal force acting thereon. As known from the above, since each alternate movable plate 33 is engaged with the diametrically opposed levers, the half number of the movable plates 33 are responsible for plucking the hairs at a time. This means that the entire bulk or numbers of hairs can be plucked in a delayed fashion to dissipate and reduce the pain or stimulus as compared to a case in which the entire number of hairs could be plucked at a once, thereby assuring a pain-less depilating operation, yet without leaving the hairs unplucked.

As described in the above, since the plucking assembly 30 is linked to the positive-return cams 70, no return spring or the like element is necessary for moving back the levers 40. Consequently, the motor 60 can be free from undue spring load and requires only small power requirement, which results in the compact design and less-power consumption of the device. Further, because of that the plucking assembly 30 and the cams 70 are in mutually supporting relation with one another, it is possible to restrict the movements of the cam 70 and the assembly 30 relative to one another in the direction parallel to the shaft axis, thereby preventing undesired vibrations thereof along the shaft axis during the above plucking operation and therefore reducing the noise. Moreover, since the levers in the diametrically opposed pairs are driven to shift in the opposite directions along the shaft axis as the plucking assembly 30 rotates, dynamic balancing is given to the device to further reduce undue vibrations and therefore noise.

Figure 6:
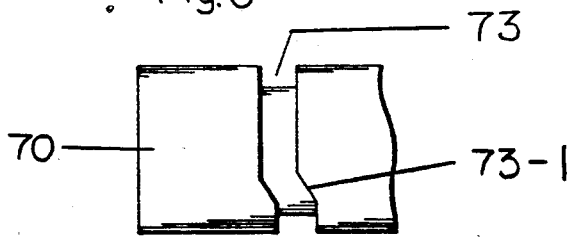
FIG. 6 is a front view of a portion of a positive-return cam utilized in the depilating device.
Figure 7:
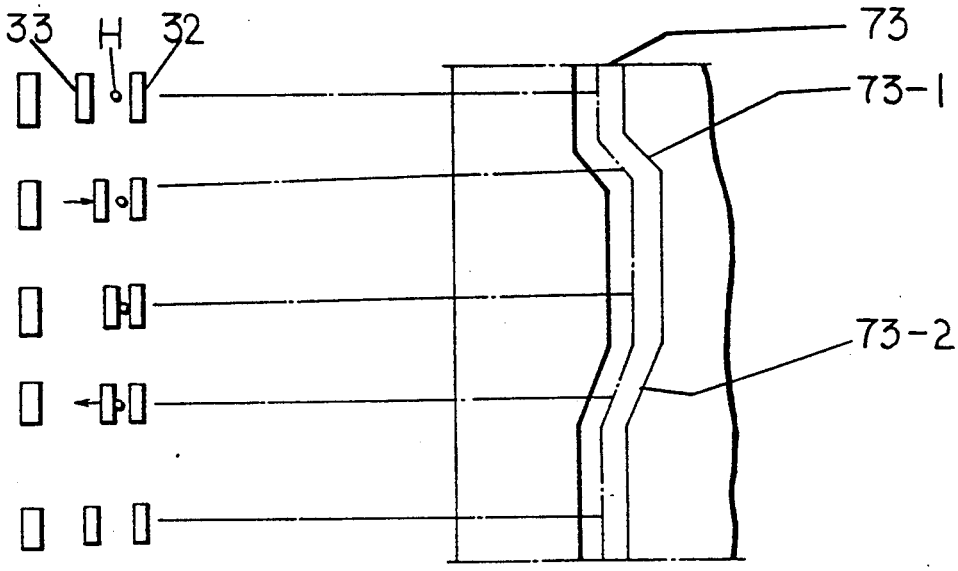
FIG. 7 is an explanatory view illustrating the operations of pinching plates in correspondence to a cam slot of the positive-return cam shown in an expanded form.
Figure 8:
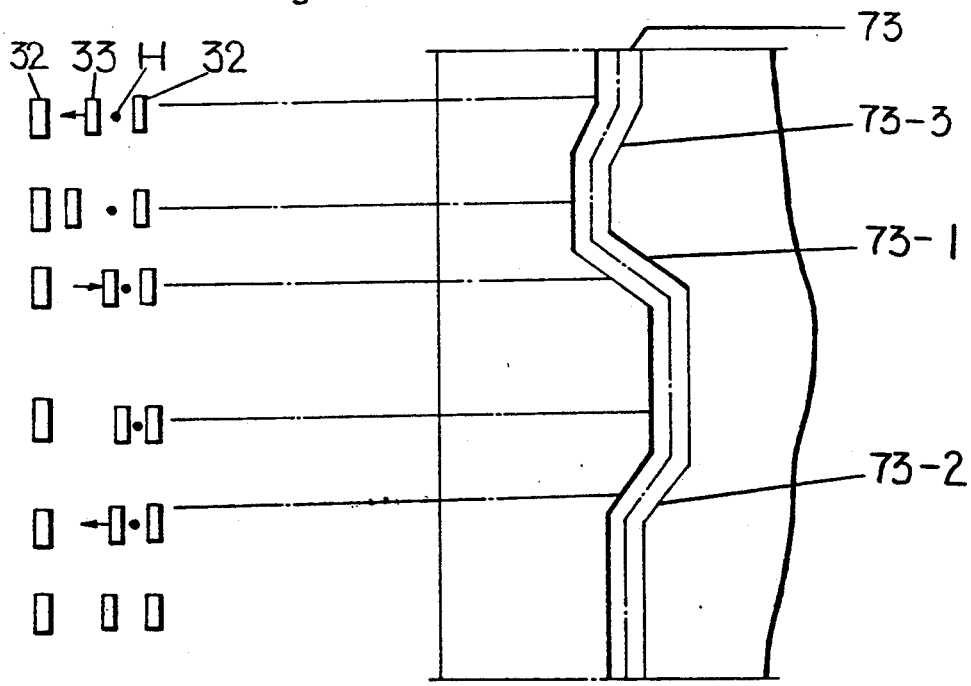
FIG. 8 is an explanatory view similar to FIG. 7 but illustrate the operations of the pinching plates for a modified cam slot configuration.

In order to effect rapid hair clamping and slow hair releasing, the cam groove 73 may be sloped inwardly at a large angle at 73-1 and sloped outwardly at a small angle at 73-2, as shown in FIGS. 6 and 7, in which the relative position of the movable plate 33 to the fixed plates 32 and the hair H to be plucked is shown in correspondence to the portion of the cam groove 73. For facilitating to introduce the hairs H, it is preferred to widen a clearance between the movable and fixed plates 33 and 32 immediately before clamping the hairs therebetween. This is achieved by a cam groove configuration as shown in FIG. 8 in which an extra outward slope 73-3 is provided immediately before the inward slope 73-1 responsible for clamping the plates 32 and 33. Also this figure shows the relative position of the movable plate 33 to the fixed plates 32 and the hair H in correspondence to the cam groove 73.

Figure 9:
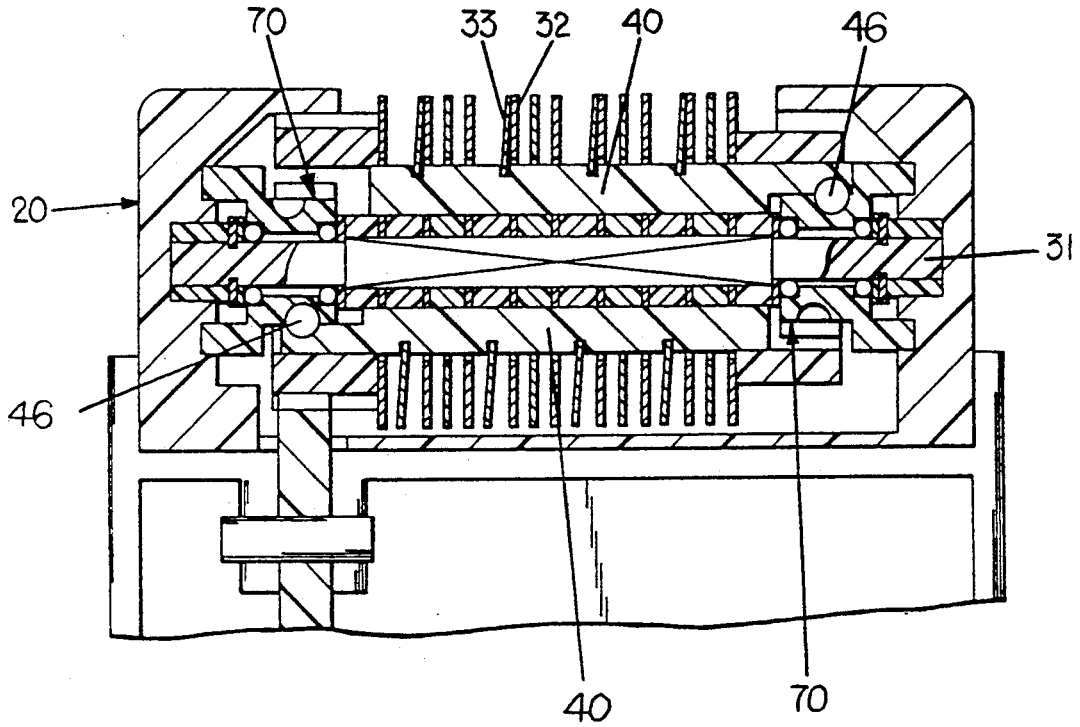
FIG. 9 is a vertical section of an upper portion of a depilating device in accordance with a modification of the above first embodiment.
Figure 10:
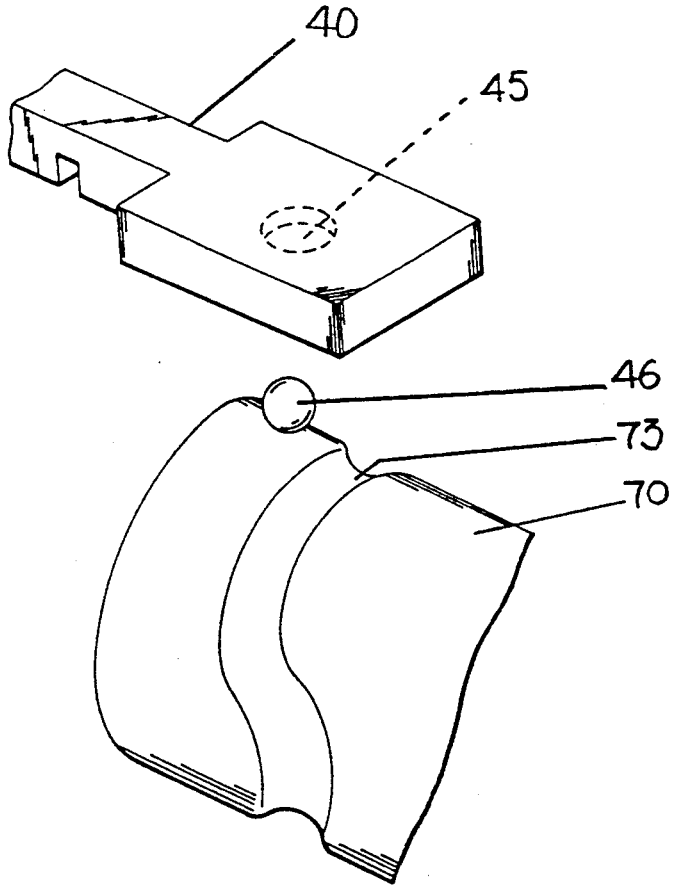
FIG. 10 is an exploded perspective view of a positive-return cam and a corresponding lever linked thereto by means of a ball utilized in the modified depilating device of FIG. 9.
Figure 11:
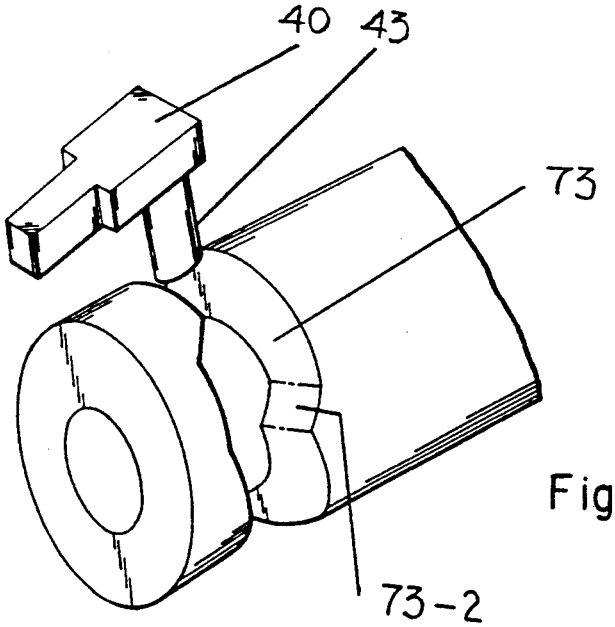
FIG. 11 is an exploded perspective view of a modified cam and a corresponding lever to be linked thereto.

FIGS. 9 and 10 illustrate a modification of the above depilating device in which the levers 40 are linked to the like positive-return cam 70 by means of balls 46. The ball 46 is retained in a socket 45 at one end of the lever 40 and projects in the cam groove 73 to effect less frictional engagement therebetween for eliminating jerky movement or noise thereat. In this connection, the lever 40 is preferably made of a rubber or the like elastic material to be engaged with the movable plates 33 without leaving any substantial gap thereat for effectively avoiding chattering at the connection between the lever 40 and the movable plates 33. The other structure and operation are identical to the above first embodiment. Therefore, like parts are designated by like numerals. As shown in FIG. 11, the cam groove 73 may be formed to have such a configuration that the corresponding roller 43 or ball is brought into positive guiding contact only with the inward slope (not seen) and the outward slope 73-2 and is in rather loosely engagement in the groove 73 between the inward and outward slopes.

Figure 12:
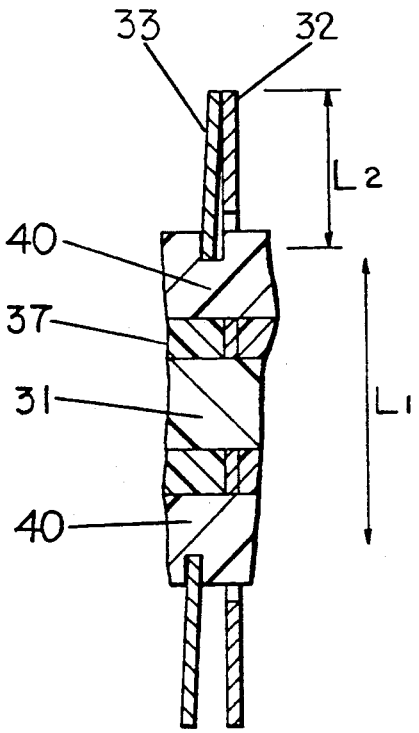
FIG. 12 is a sectional view illustrating the mounting structure of the pinching plates of the first embodiment.
Figure 13:
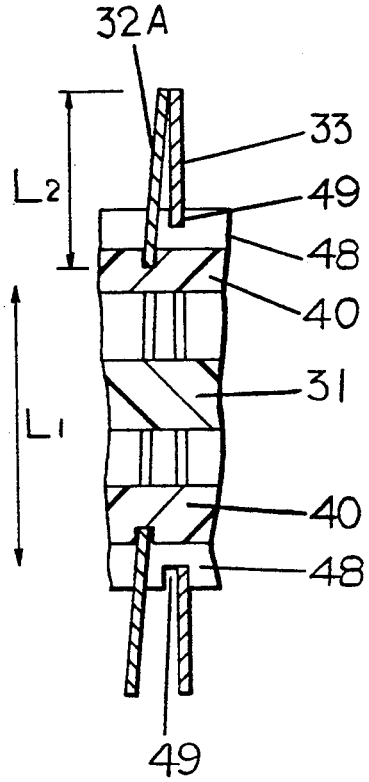
FIG. 13 is a sectional view illustrating the mounting structure of the pinching plates in accordance with another modification of the first embodiment.

In the above embodiment, the fixed plates 32 are held stationary in the axial direction of the shaft 31 as being held between the collars 37, as Shown in FIG. 12. However, the fixed plates 32A may be driven to shift in the axial direction in the like manner as the movable plates 33, as shown in FIG. 13, in which the fixed plates 32A are supported on additional reciprocating levers 48 which are driven by the common cams or additional cams. In this sense, the fixed plates 32A are shaped into like configuration as the movable plates 33 and engaged with notches 49 of the additional levers 48. In either case, the movable plates 33 and 32A are caused by a force applied from the lever to swing or pivot about a fulcrum located on the opposite side of the force point from the shaft axis, as shown in FIGS. 12 and 13. This is advantageous in obtaining the relation that a distance L1 between the fulcrum and the force point is much greater than a distance L2 between the force point and the action point, thereby obtaining a relatively strong clamping force at the contacted edge of the movable plate 33 against the corresponding edge of the fixed plate 32, yet keeping the overall diameter of the plucking assembly 30 at a minimum for compact design of the device.

Figure 14:
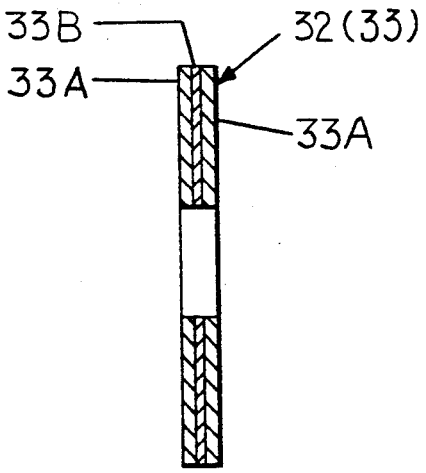
FIG. 14 is a sectional view of a modified pinching plate which may be utilized in the depilating device of the above first embodiment.
Figure 15:
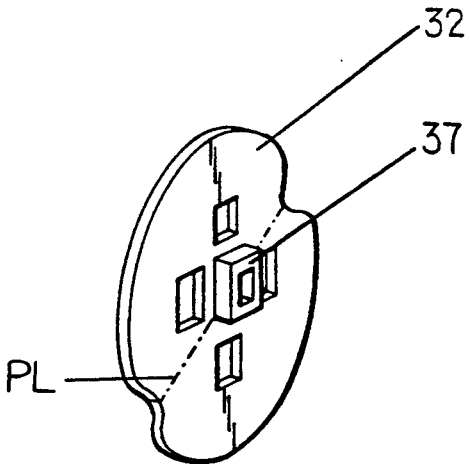
FIG. 15 is a perspective view of a modified pinching plate which may be utilized as being fixed to a rotary shaft of the depilating device of the above first embodiment.
Figure 16:
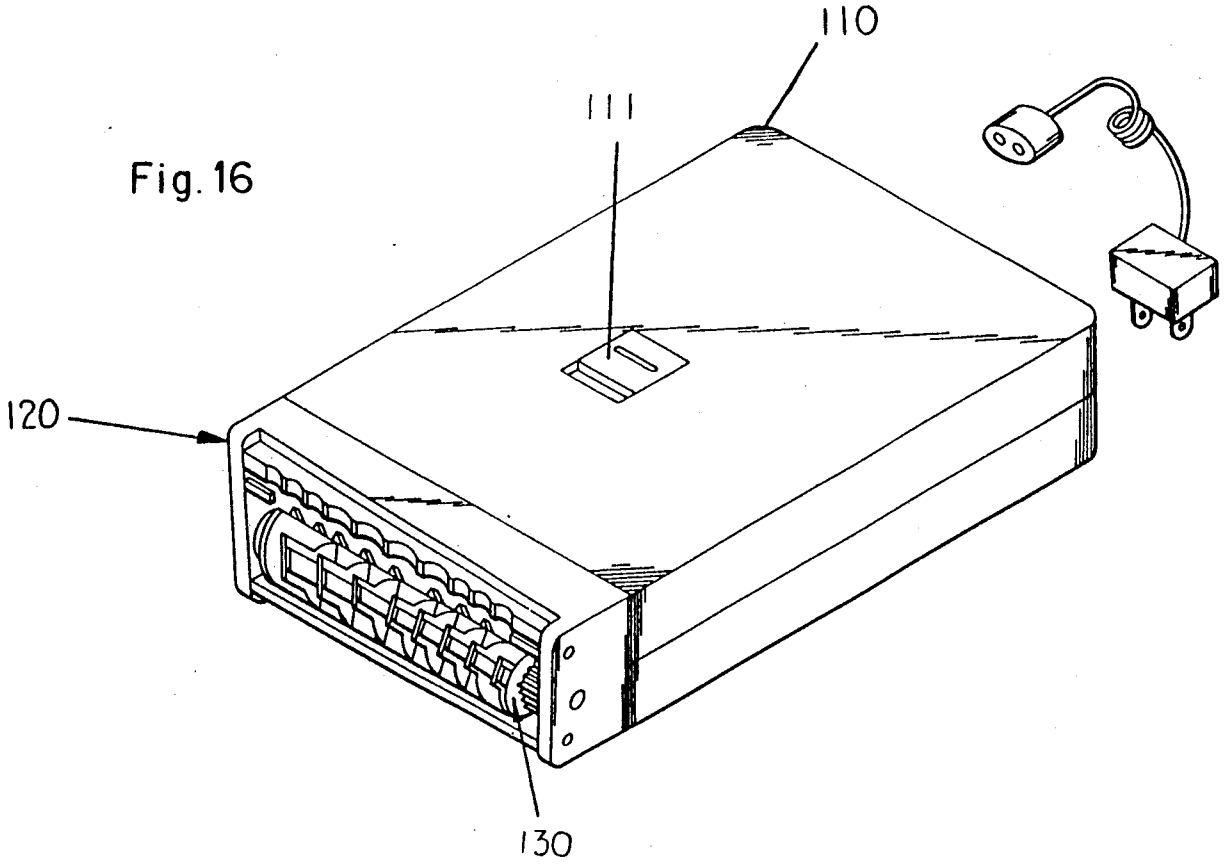
FIG. 16 is a perspective view of a depilating device in accordance with a second embodiment of the present invention.

For reducing the impact noise at the contacting engagement between the fixed and plates 32 and 33, it is preferred to design at least either of the fixed plates 32 or movable plates 33 as a shock-absorbing plate which is, as shown in FIG. 14, fabricated from a pair of steel plates 33A and a viscoelasticity sheet 33B sandwiched therebetween. As shown in FIG. 15, the fixed plate 32 may be fabricated to have the collar 37 integrally formed therewith, such as by molding the fixed plate from ceramics or by forming the fixed plate from the metal sheet to have the integral collar stamped therefrom. When the fixed plate 32 is molded from the ceramics, it is preferred to locate a mold parting line PL between recessed edges of the plate 32 for avoiding the resulting burrs from appearing on a skin contacting edge.

Second Embodiment <FIGS. 16 to 32>

Figure 17:
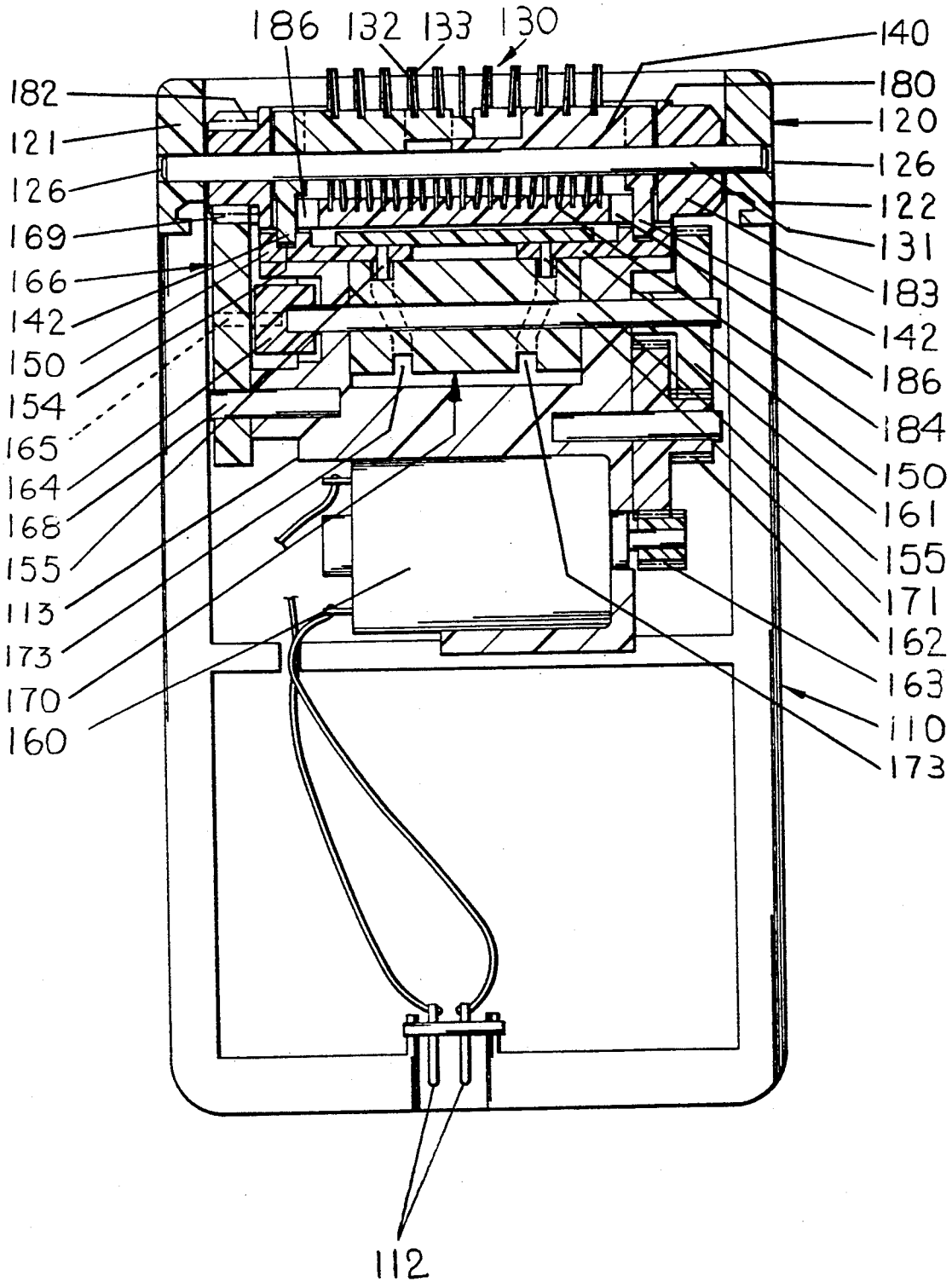
FIG. 17 is a vertical section of the depilating device.
Figure 18:
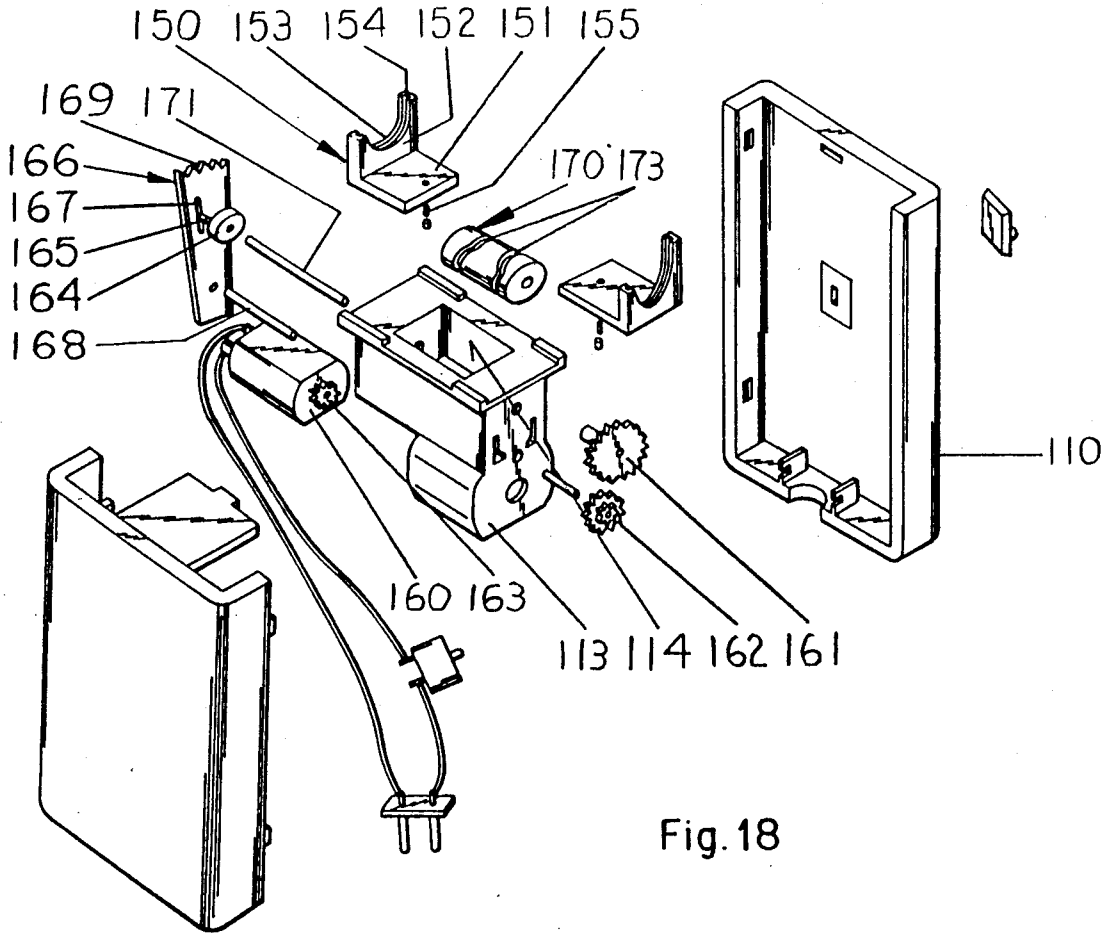
FIG. 18 is an exploded perspective view of a housing of the depilating device of FIG. 16.
Figure 19:
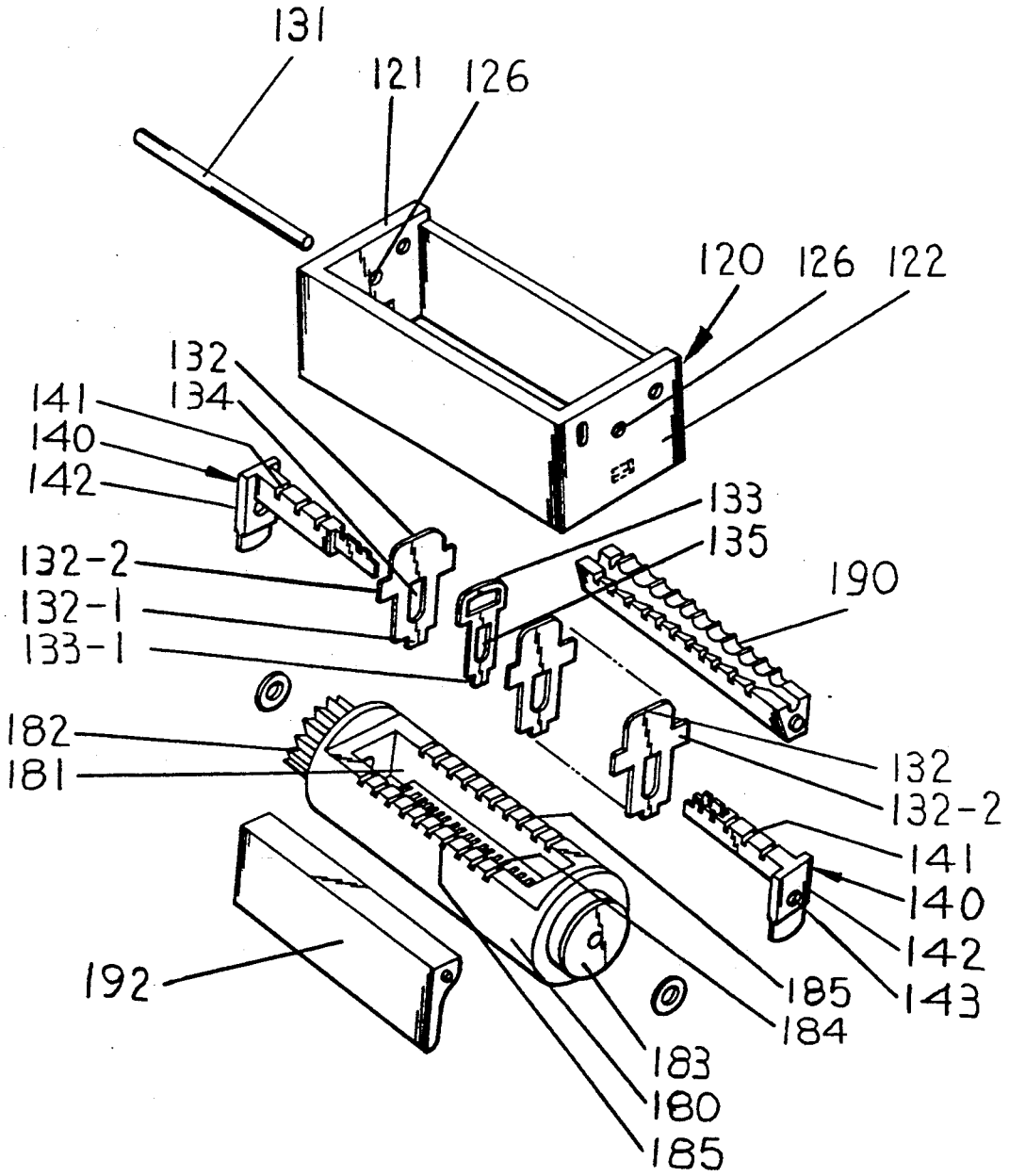
FIG. 19 is an exploded perspective view of a depilator head of the depilating device of FIG. 16.

Referring to FIGS. 16 to 19, there is shown a depilating device in accordance with a second embodiment of the present invention. The device comprises a depilator head 120 mounted on a housing 110 and including a plucking assembly 130. The housing 110 incorporates a holder 113 mounting a motor 160, a positive return cam 170, and a drive mechanism for the plucking assembly 130. The housing 110 is provided with a switch handle 111 for turning on and off the motor 160 and with a pair of terminal pins 112 for electrical connection to a power source. As best shown in FIG. 19, the head 120 is in the form of a top and bottom opened rectangular frame having a pair of end walls 121 and 122 between which the plucking assembly 130 is received. The plucking assembly 130 comprises a shaft 131 supported at its opposite ends respectively in holes 126 in the end walls 121 and 122, a barrel 180 carrying a series of fixed and movable plates 132 and 133 alternating along the length of the barrel 180, and a pair of reciprocating levers 140 received within a top-opened slot 181 in the barrel 180. The shaft 131 extends through the barrel 180 so as to rotatably support the barrel 180 about the shaft axis. Alternately, the barrel 180 may rotate together with the shaft 131 while rotatably supporting the shaft 131 relative to the end walls 121 and 122 of the head 120. Integrally formed at one axial end of the barrel 180 is a gear 182 which is connected through the drive mechanism to the motor 160 for oscillating the barrel 180 about the shaft axis. The barrel 180 is received within the head 120 with the end faces of the gear 182 and the boss 183 in loosely abutting or closely adjacent relation respectively to the interior surfaces of the end walls 121 and 122.

The slot 181 of the barrel 180 is elongated in the axial direction and is opened to a flattened top surface of the barrel 180. The bottom of the slot 181 is formed with a row of bottom slits 184 evenly spaced along the axial direction for receiving the lower ends 132-1 and 133-1 of the individual fixed and movable plates 132 and 133. The fixed plates 132 are each formed at its upper end portion with a pair of sideward extending tabs 132-2 which are engaged into Ones of side slits 185 formed in the top surface of the barrel 180 on both sides of the slot 181. Thus, the fixed plates 132 is supported on the barrel 180 to be movable therewith about the shaft axis but fixed relative to the barrel 180, and the movable plates 133 are allowed to swing about the lower anchored ends 132-1 in the axial direction relative to the barrel 180 or the adjacent fixed plates 132, while they are movable together with the fixed plates 132 or the barrel 180 about the shaft axis. The fixed and movable plates 132 and 133 are formed respectively with vertically elongated holes 134 and 135 through which the shaft 131 and the levers 140 extend. Each of the levers 140 is provided with a series of notches 141 for engagement with the upper edges of the holes 135 in the movable plates 133 so as to displace or swing the movable plates 133 as the lever 140 reciprocate in the axial direction, thereby repeating to clamp the hairs between the upper edges of the movable plates 133 and the adjacent plates 132 and release the hairs therefrom. Such axial movement of the movable plates 133 occurs in synchronism with the oscillatory movement of the barrel 180 so that the hairs once clamped between the adjacent plates 132 and 133 can be pulled away as the barrel 180 moves about the shaft axis in one direction.

The levers 140 are aligned in the axial direction with the inner end of one lever 140 slidably engaged in the corresponding end of the other lever 140. Depending from the outer end of each lever 140 is a leg 142 which extends through each one of cuts 186 in the bottom of the barrel 180 for connection with each one of sliders 150 supported on the upper end of the holder 113 in the housing 110. The shaft 131 extends loosely through a hole 143 in each leg 142 so that the lever 140 connected through the movable plates 133 to the barrel 180 can rotate together with the barrel 180 about the shaft 131 but is allowed to reciprocate along the shaft 131. Also included in the depilating head 120 is a comb member 190 which is detachably disposed in parallel with the barrel 180 to have its combing surface projecting beyond the opening of the head 120 for the purpose of raising the hairs prior to being clamped between the plates 132 and 133. On the opposite side of the barrel 180 there is disposed a detachable collector 192 which extends in parallel with the barrel 180 for collecting the plucked hairs.

Figure 20:
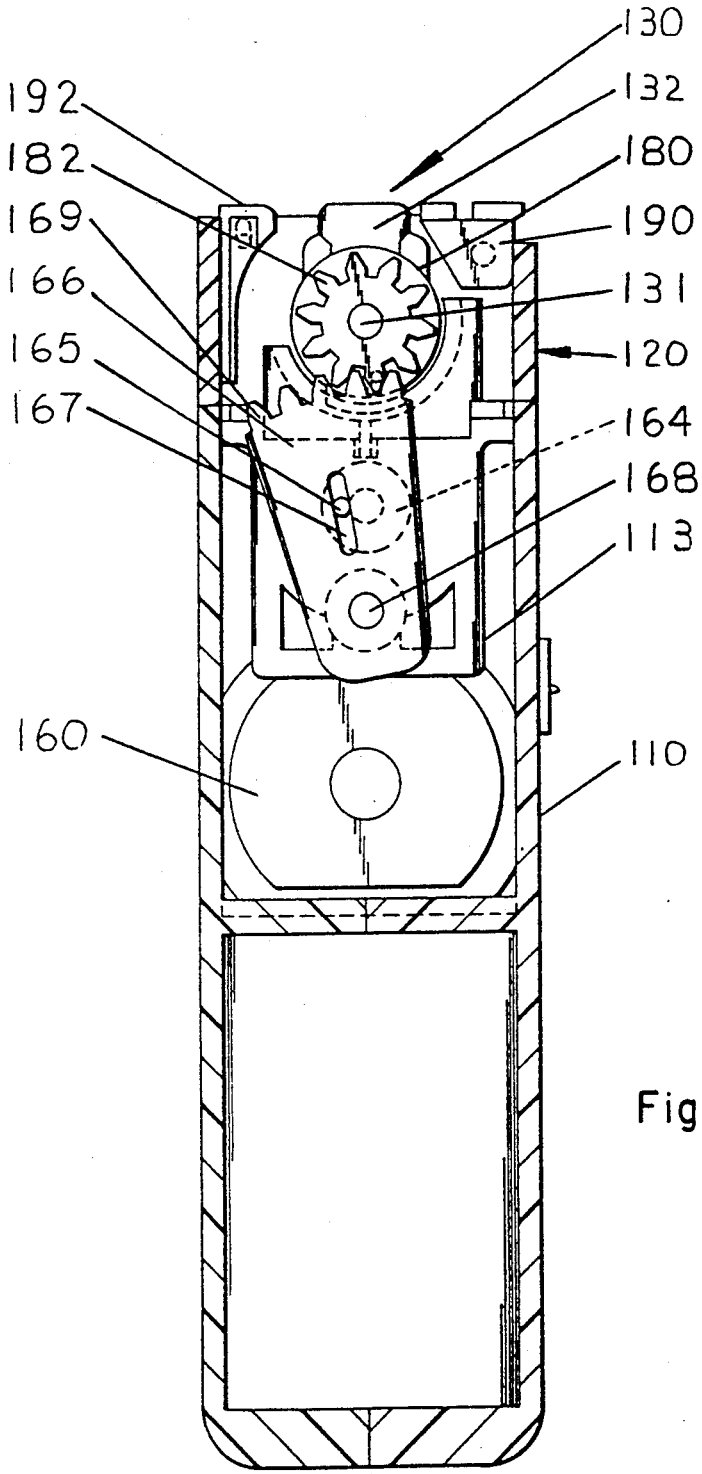
FIG. 20 is a vertical section taken along line 20—20 of FIG. 17.
Figure 21:
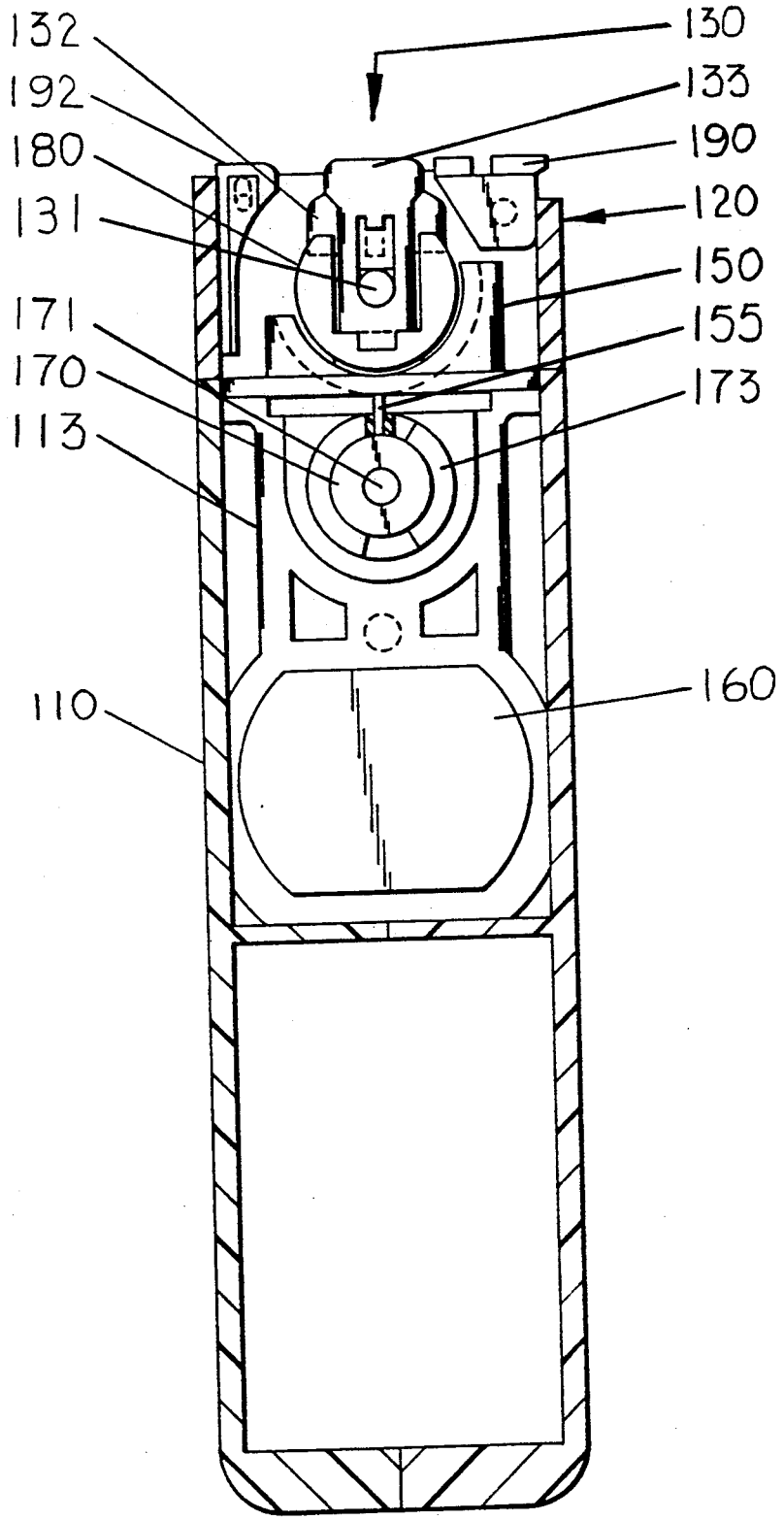
FIG. 21 is a vertical section taken along line 21—21 of FIG. 17.

As shown in FIGS. 17 and 18, the holder 113 has a cavity 114 for receiving therein the positive-return cam 170 in the form of a cylinder cam with a pair of grooves 173 of symmetrical configuration. The cam 170 is supported on a cam shaft 171 to be rotatable therewith. The cam shaft 171 has its opposite ends extending horizontally through the opposite end walls of the holder 113 to be journaled thereat. One end of the shaft 171 carries a reduction gear 161 which is in meshing engagement through an intermediate gear 162 with a drive gear 163 on an output shaft of the motor 160 so that the cam 70 is driven to rotate about the cam shaft axis. Fitted on the other end of the cam shaft 171 is a cam disk 164 with a pin 165 which is eccentric to the cam shaft 171 and engages into a vertical slot 167 in a cradle lever 166 pivotally supported on the side of the holder 113 about a pivot pin 168. The cradle lever 166 is formed at its upper end opposite of the pivot pin 168 from the slot 167 with teeth 169 which is in meshing engagement with the gear 182 of the barrel 180, as best shown in FIG. 20. Thus, as the cradle lever 166 pivots about the pivot pin 168 by the engagement of the eccentric pin 165 into the slot 167, the barrel 180 is caused to oscillate about the shaft 131 in synchronism with the rotation of the cam 170 and the cam disk 164. As shown in FIGS. 27A to 27E, the barrel 180 oscillates over an angular range of about 100° from a retracted position of FIG. 27A in which the plates 132 and 133 are hidden within the head 120 and an operating position of FIG. 27C in which the plates 132 and 133 project upright beyond the head 120 for clamping the hairs therebetween. The barrel 180 completes one oscillation cycle per one rotation of the cam 170.

Figure 26:
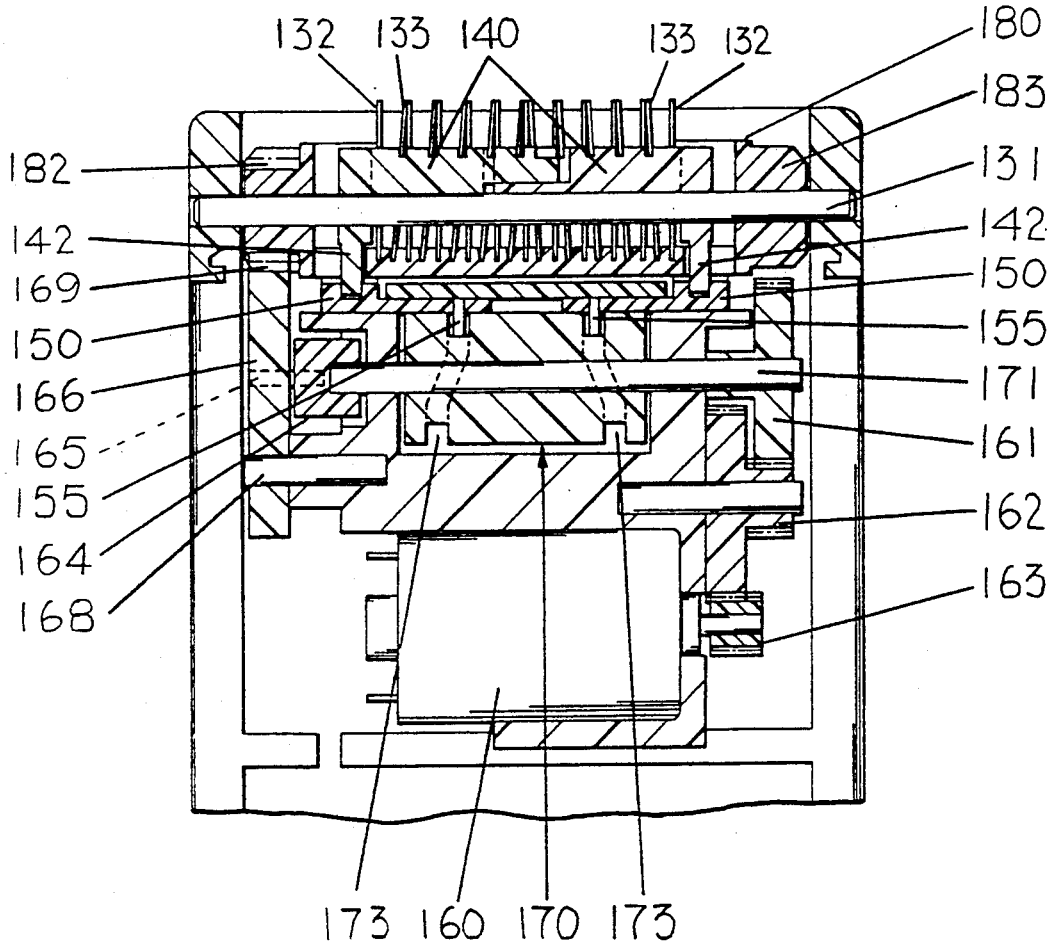
FIG. 26 is a vertical section of the above depilating device in its clamping condition for clamping the hair between the adjacent movable and fixed pinching plates.
Figure 29:
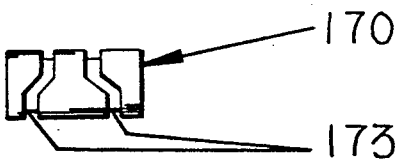
FIG. 29 is a front view of a positive-return cam utilized in the above depilating device.
Figure 30:
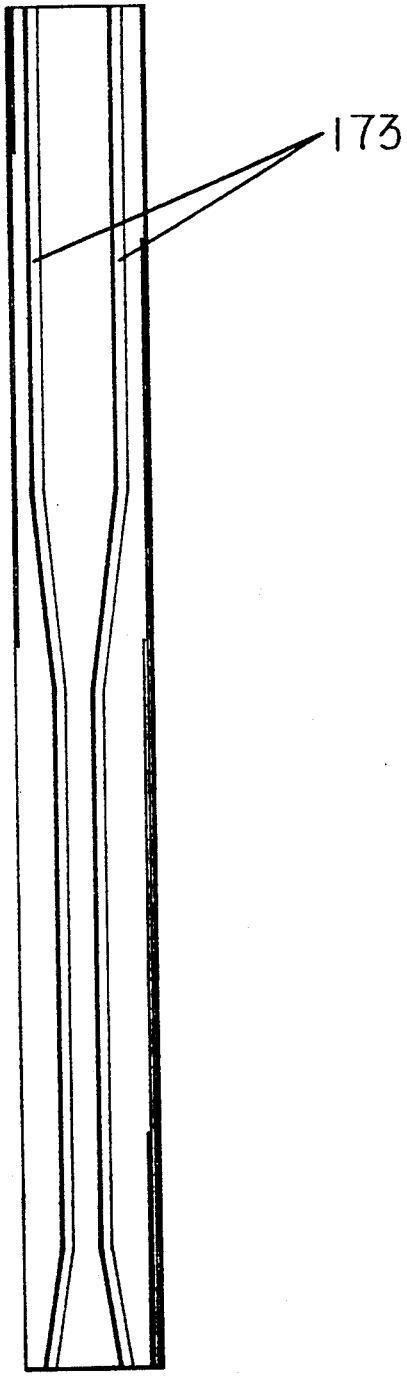
FIG. 30 is an expanded view of the positive-return cam.

Each of the sliders 150 slidably mounted on the holder 113 comprises a base 151 and a bracket 152 upstanding from the outer end of the base 151. The bracket 152 is formed with a round recess 153 with an arcuate furrow 154 which extends along the perimeter of the recess over the angular range of more than 100° for receiving the lower end of the leg 142 of each lever 140. Each one of the sliders 150 is connected to the positive-return cam 170 with a follower pin 155 on the base 151 engaging into each one of the cam grooves 173 that the sliders 150 are caused to reciprocate in parallel with the cam axis and the shaft axis of the barrel 180 in the opposite directions as the cam 70 is driven by the motor 160 to rotate about the cam axis. The cam grooves 73 are configured, as shown in FIGS. 29 and 30, such that the sliders 150 and the levers 140 linked thereto are caused to reciprocate one cycle per one rotation of the cam 170. During the reciprocating movement of the levers 140, the movable plates 133 engaged with each of the levers 140 are caused to swing about their lower ends to displace their upper edges to and from the adjacent fixed plates 132, thereby effecting to plucking the hairs as repeating to clamp the hairs between the adjacent plates 132 and 133, to pull the hairs in combination with the oscillatory movement of the plates 132 and 133, and to release the hairs therefrom. Such plucking operation can be easily understood from FIGS. 28A to 28E which illustrate the relative position of the movable plate 133 to the adjacent fixed plates 132 and the hair H to be plucked in correspondence to the oscillatory movement of the barrel 180, as shown in FIGS. 27A to 27E. That is, in the retracted position of the barrel 180 [FIG. 27A], the movable plate 133 is spaced away from one of the adjacent fixed plates 132 [FIG. 28A]. As the barrel 180 advances to an intermediate position [FIG. 27B] where one lateral edges of the plates 132 and 133 just reaching the opening of the head 120, the movable plate 133 is still spaced away from the adjacent fixed plate 132 to be ready for introducing the hair H between the plates 132 and 133, which condition is shown in FIG. 17. Subsequently when the barrel 180 comes into the operating position [FIG. 27C], the movable plate 133 swings to have its upper end in close contact with the adjacent fixed plate 132 so as to clamp the hair H therebetween [FIG. 28C], which condition is also shown in FIG. 26. Thereafter, the barrel 180 moves back to the intermediated position [FIG. 27D] as clamping the hair H between the plates 132 and 133 [FIG. 27D]. It is during this rotary movement from the position of FIG. 27C to the position of FIG. 27D that the hair H is pulled away from the skin. It is noted at this time that the hair H can be pulled out in the growing direction with the oscillatory movement of the barrel 180, assuring less-irritating hair plucking. Finally, the barrel 180 returns to the retracted position [FIG. 27E] with the movable plate 33 spaced away from the adjacent fixed plate 132 [FIG. 28E], thereby completing one hair plucking cycle. The plucked hair H is flew outwardly into the collector 192 during the movement of the barrel 180 from the position of FIG. 27D to the position of FIG. 27E.

Figure 22:
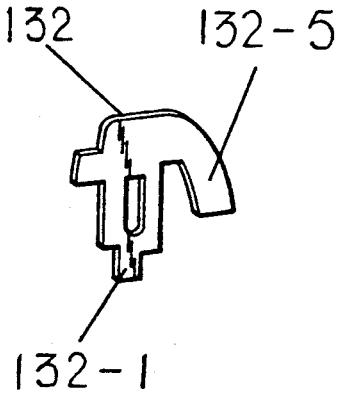
FIGS. 22 and 23 are perspective views of modified fixed pinching plates which may be utilized in the depilating device.
Figure 23:
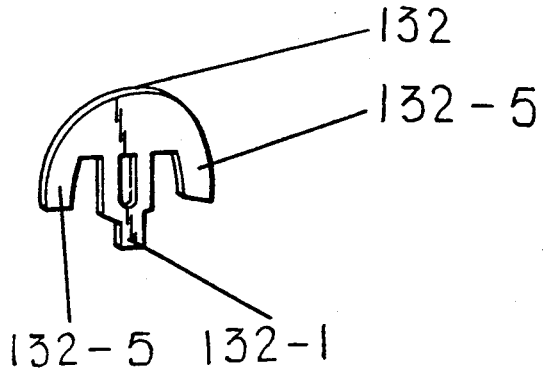
Figure 24:
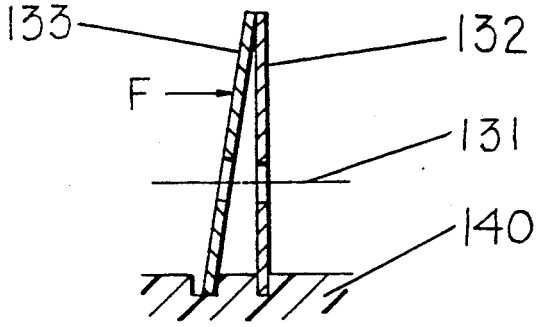
FIG. 24 is an explanatory view illustrating the force applied to a movable pinching plate for displacing it against the adjacent pinching plate.
Figure 25:
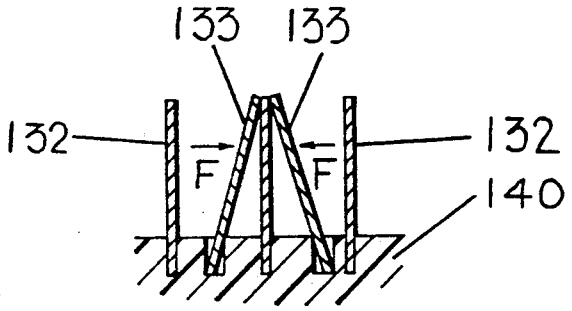
FIG. 25 is an explanatory view illustrating the forces applied to two adjacent movable pinching plates for displacing it against a center fixed pinching plate disposed between the two adjacent movable pinching plate.
Figure 27A:
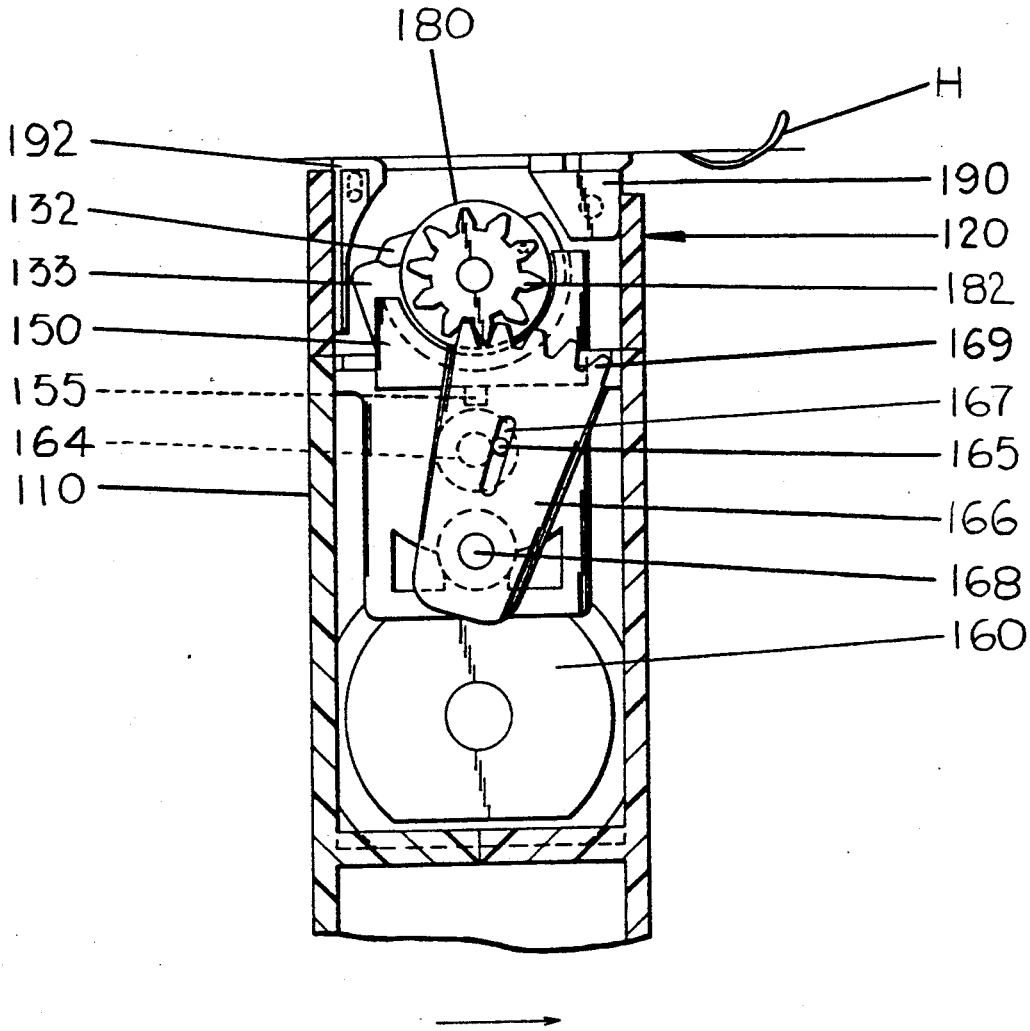
FIGS. 27A to 27E are vertical sections illustrating the oscillating movement of a plucking assembly of the depilating device.
Figure 28A:
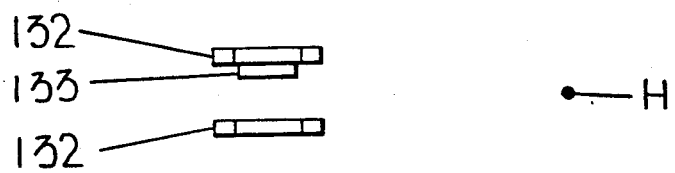
FIGS. 28A to 28E are explanatory views illustrating the operation of pinching plates in correspondence respectively to FIGS. 27A to 27E.
Figure 27B:
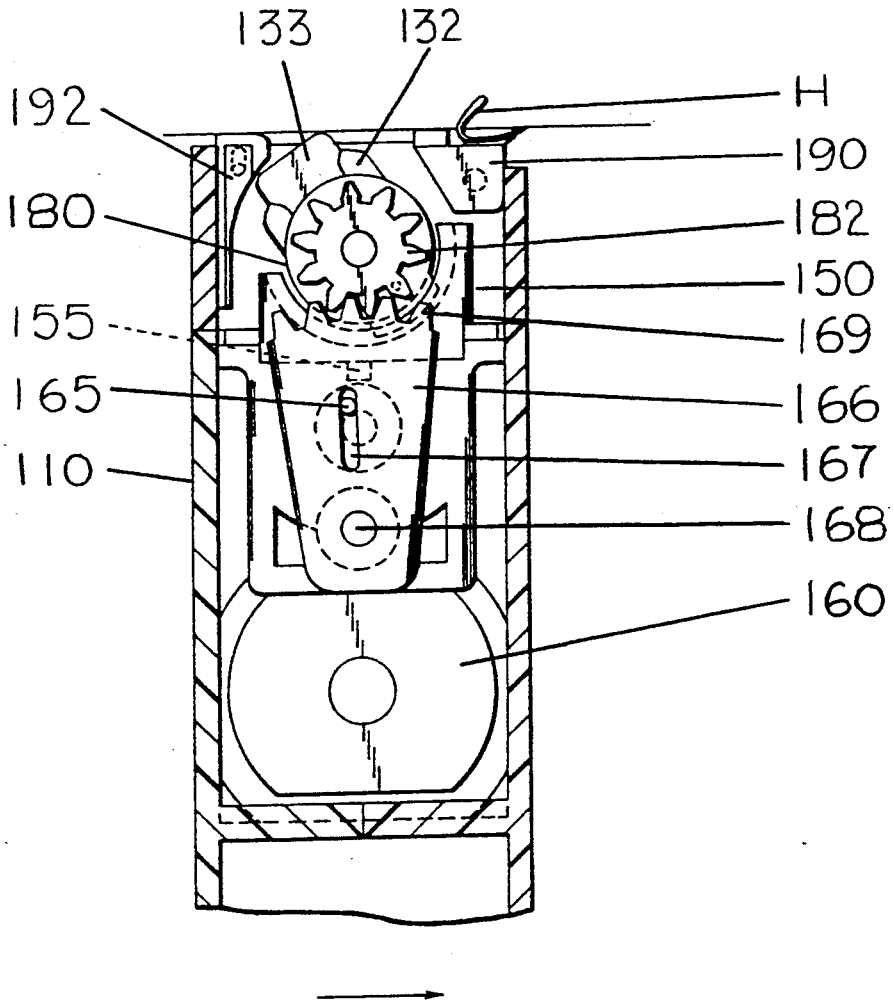
Figure 28B:
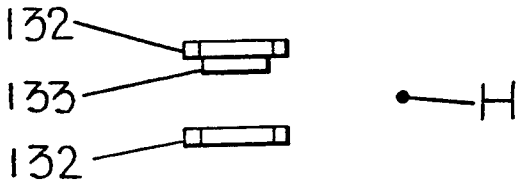
Figure 27C:
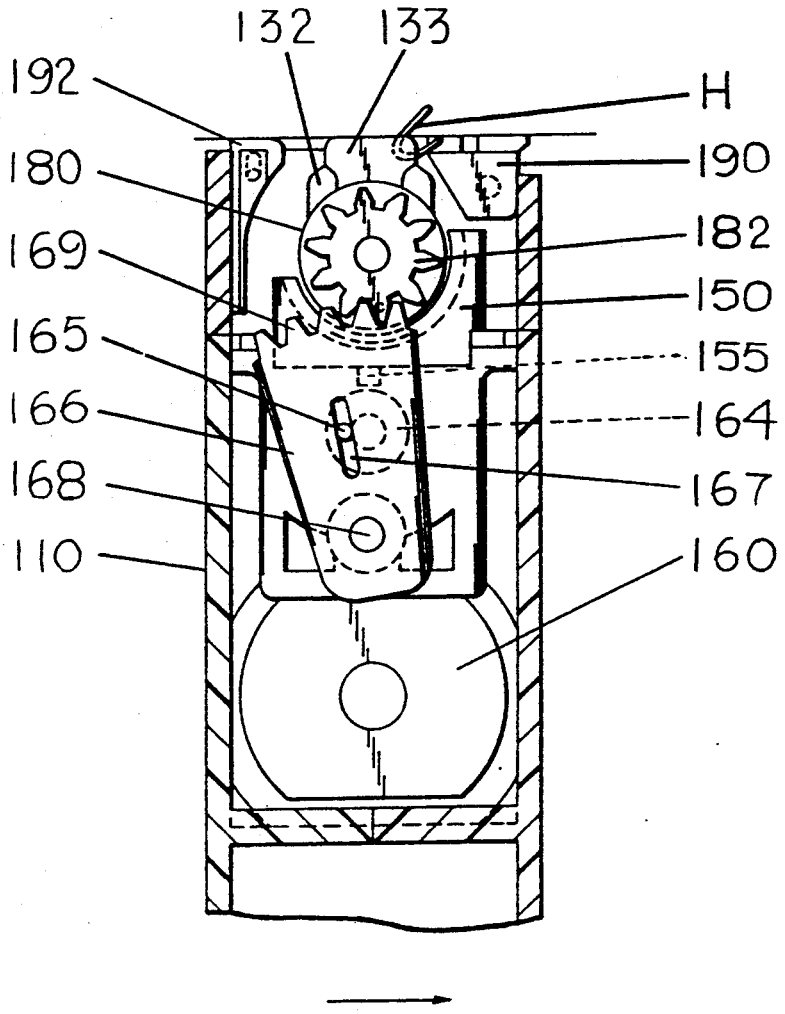
Figure 28C:
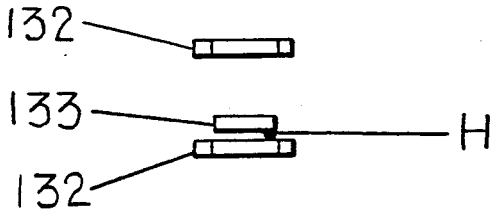
Figure 27D:
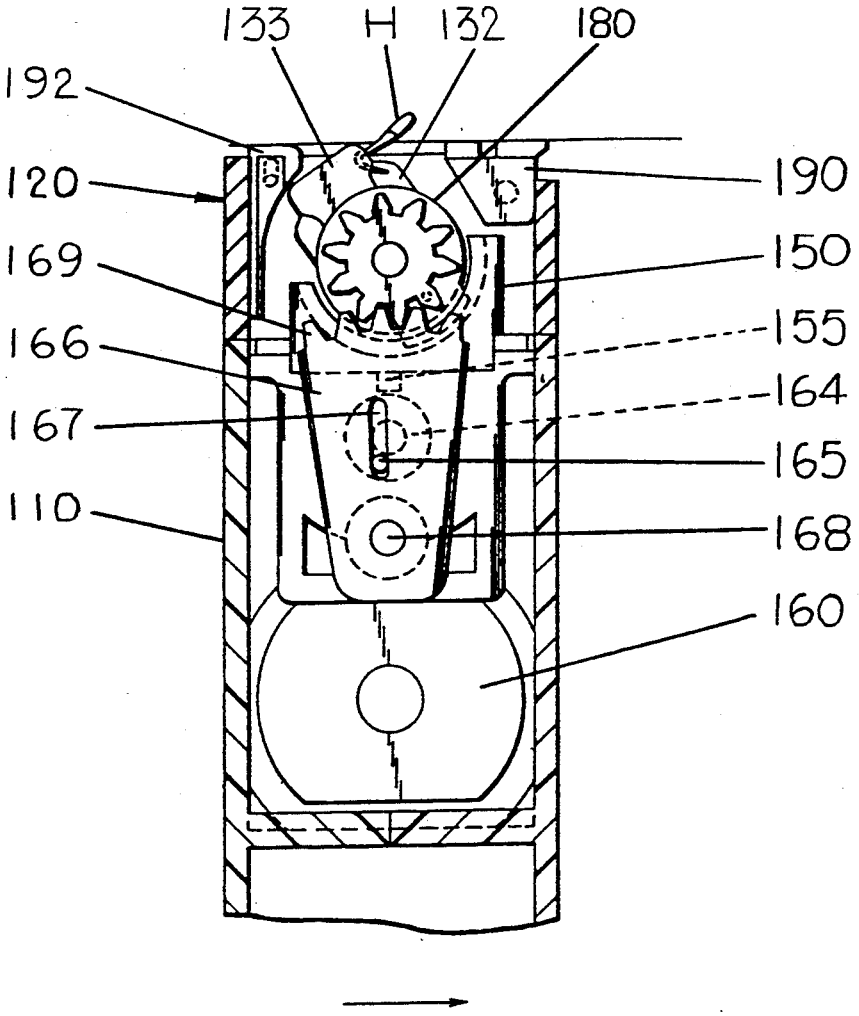
Figure 28D:
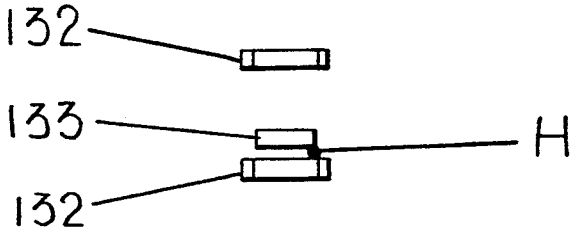
Figure 27E:
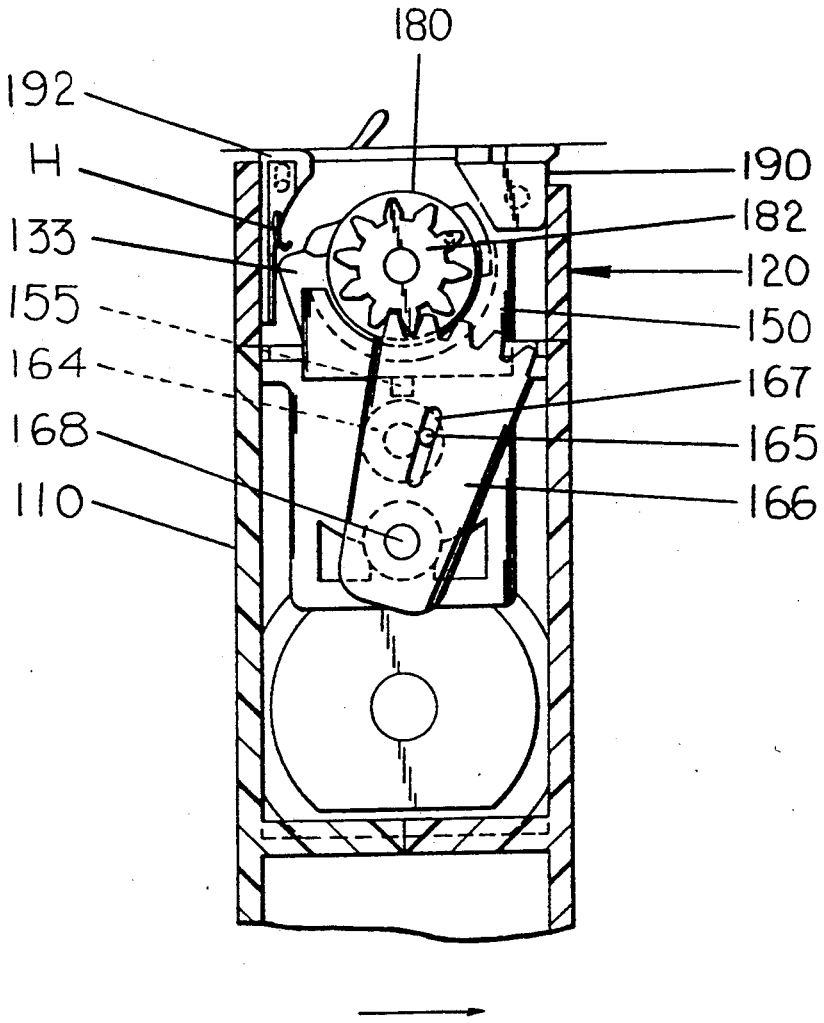
Figure 28E:
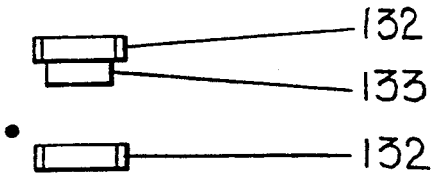

It should be noted at this time that, as shown in FIGS. 27A to 27E, the cradle lever 166 pivots slower from the positions of FIG. 27A to FIG. 27C than from the positions of FIG. 27C to 27E due to the varying distance between the pivot pin 168 and the eccentric pin 165 engaged in the slot 167 of the cradle lever 166. Thus, the plates 132 and 133 can be gradually brought into contact with the skin so as not irritate the skin as well as not to miss the hairs. And once the hairs are clamped between the plates 132 and 133, the plates are driven to reverse its rotating direction and then rotate faster so as to quickly pull the hairs out of the skin for reducing the pain. During the hair plucking, the comb member 190 can act to stretch the skin in the direction opposite to the hair pulling direction by manipulating to move the device as indicated by an arrow in FIGS. 27D and 27E, thereby further facilitating the hair plucking with less irritation to the skin. As shown in FIG. 26, when the movable plates 133 are in the clamping position, all the movable plates 133 are driven to swing inwardly to have the individual upper ends in close contact with the inwardly adjacent fixed plates 132 in consequence of that both of the levers 140 are shifted inwardly, thus providing dynamic balancing for reducing undue vibration or noise. During this swinging movement of the movable plates 133, they are received from the corresponding levers 140 forces F which, as shown in FIGS. 24 and 25, act on a point intermediate the point of action [i.e., contacting edge] and the axis of the shaft 131. Whereby, it is readily possible to obtain sufficient clamping action force at the upper edge with a relatively small force F from the lever 140, which contributing to reduce the power requirement and the operation noise. The fixed plates 132 may be formed to have an arcuately curved edge 132-5 on one side thereof, as shown in FIG. 22, or to have a pair of like curved edges 132-5 on both sides thereof, as shown in FIG. 23, in order to provide a smooth contact with the skin during the oscillating movement of the barrel 180. Also in this embodiment, the positive-return cam 170 is kept in a mutually supporting relation to the plucking assembly 130 or the barrel 180 in the axial direction. Therefore, the relative axial movement of one of the cam 170 and the barrel 180 is restricted by the other so that the cam 170 and the barrel 180 are prevented from vibrating in the axial direction during the plucking operation to greatly reduce the noise occurring at the supporting structures of the cam 170 and the barrel 180. In this connection, it is contemplated to leave no substantial gap at the engagement of the follower pins 155 of the sliders 150 in the respective grooves 173 as well as at the engagement of the legs 142 of the levers 140 in the furrows 154 of the corresponding sliders 150.

Figure 31:
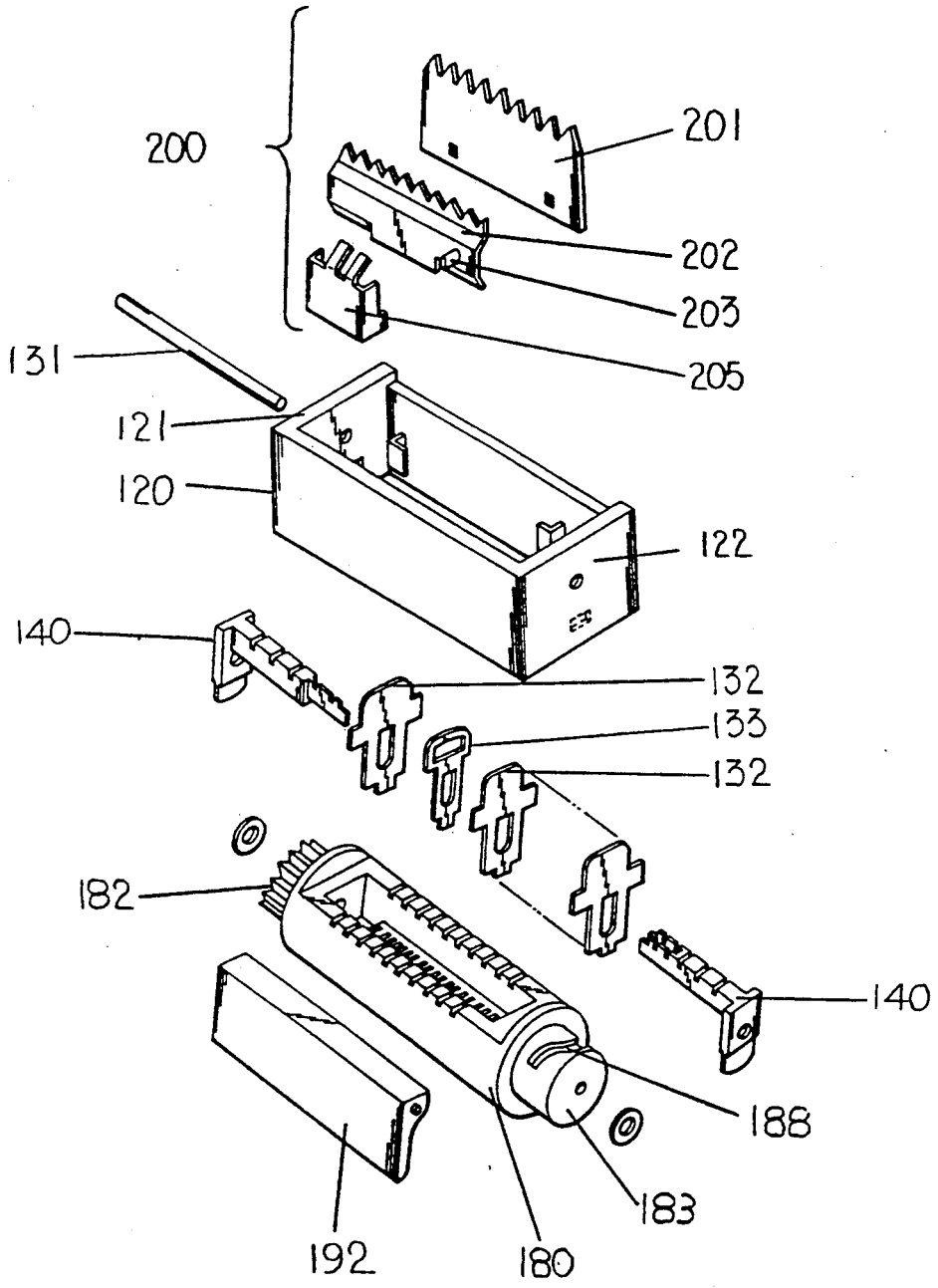
FIG. 31 is an exploded perspective view of a modified depilator head additionally including a trimmer which may be utilized in the above depilating device.
Figure 32:
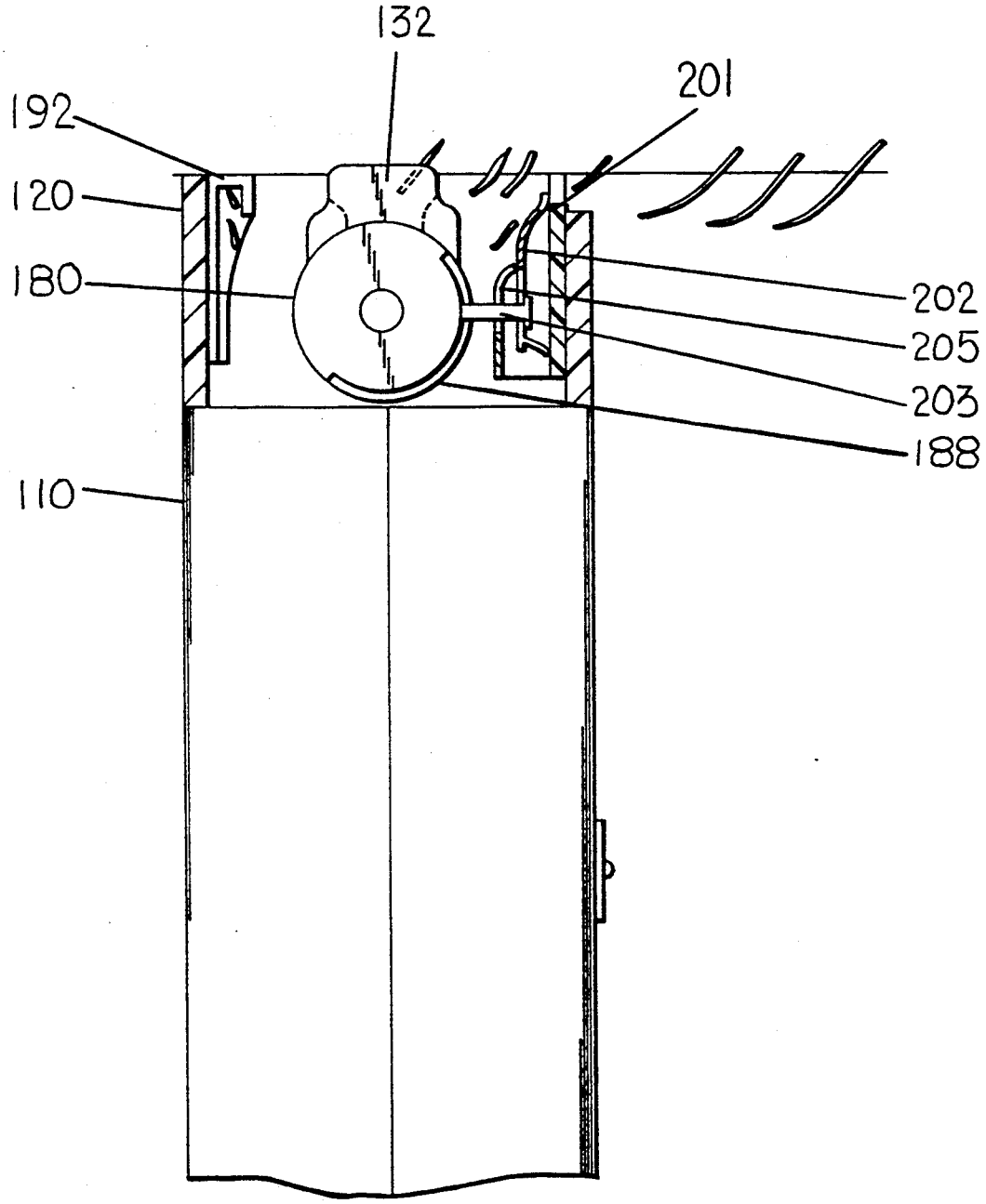
FIG. 32 is a sectional view illustrating the operation of the depilator head of FIG. 31.

FIGS. 31 and 32 illustrate a modified depilating device which is identical in structure and operation to the above second embodiment except that a trimmer 200 is included in place of the comb member 190. Therefore, like parts are designated by like numerals. The trimmer 200 comprises a stationary blade 201 with a toothed edge and a movable blade 202 with a like toothed edge in hair shearing engagement with the toothed edge of the stationary blade 201. The stationary blade 201 is supported in the head 120 with its toothed edge projecting to substantially the same height of the upper edges of the plates 132 and 133 in the clamping position, as shown in FIG. 32, so that the toothed edge is in contact with the skin. The movable blade 202, on the other hand, has its toothed edge receded inwardly from the corresponding edge of the stationary blade 201 so as not to be in direct contact with the skin. Formed at one lateral end of the movable blade 202 is a pin 203 which engages in a cam slot 188 in the surface of the boss 183 at the end of the barrel 180 so that the movable blade 202 is driven to reciprocate relative to the stationary blade 201 in synchronism with the rotation of the barrel 180, for cutting the hairs to a short length prior to being plucked by the plates 132 and 133. The movable blade 202 is biased against the stationary blade 201 by means of a spring member 205 supported on the stationary blade 201. With the use of the trimmer 200, the hairs can be cut to a short length sufficiently such that the hairs can be successfully clamped between the plates 132 and 133 and can be plucked without causing serious pain. In this connection, the toothed edge of the stationary blade 201 in contact with the skin also acts to comb or raise the hairs for easy introduction into between the plates 132 and 133.

Third Embodiment <FIGS. 33 to 38>

Figure 37:
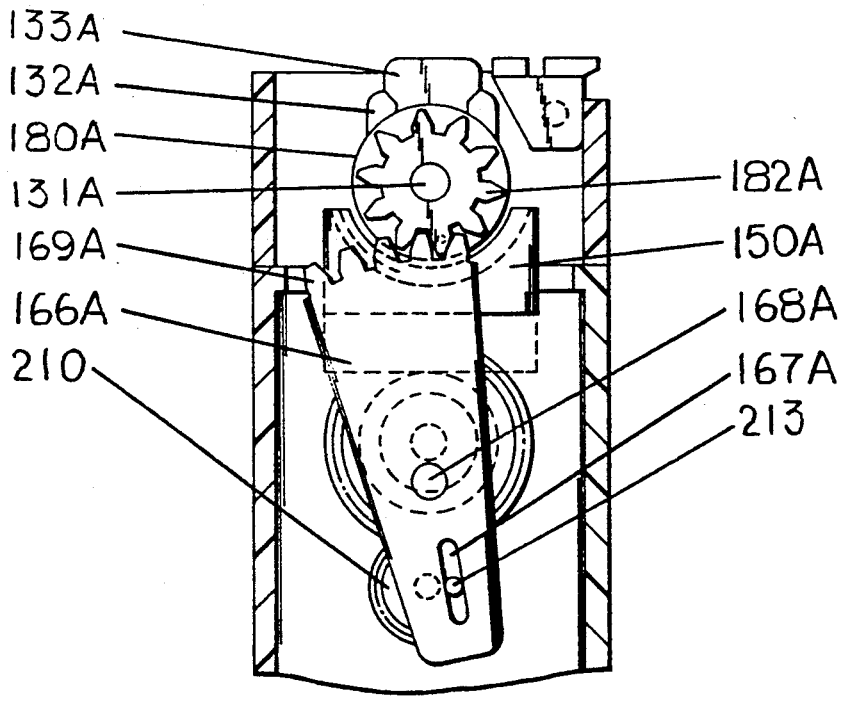
FIG. 37 is a vertical section illustrating the oscillatory movement of the depilator head of the depilating device.

A depilating device in accordance with a third embodiment of the present invention is similar to the above second embodiment but provides a somewhat different hair plucking mode. The like parts are designated by like numerals as used in the second embodiment with a suffix letter of "A". The different hair plucking mode is characterized to oscillate the barrel 180A two cycles or strokes per one rotation of the positive-return cam 170 and also to swing each movable plate 132A in opposite directions in order to have its upper edge in hair clamping contact with the two adjacent fixed plates 132A alternately within One reciprocation of the corresponding lever 140A, i.e., one rotation of the cam 170A. To this end, a cam gear 210 is provided to be in meshing engagement with a reduction gear 161A on the cam shaft 171A. The cam gear 210 is fixed on one end of an additional shaft 211 which is rotatably supported on the holder 113A and has a gear 212 at the other end for driving connection through the intermediate gear 162A with the drive gear 163A of the motor 160A. The cam gear 210 meshes with the reduction gear 161A in such a driving connection that the cam 170A completes one rotation per two rotations of the cam gear 210. The cam gear 210 carries an eccentric pin 213 engaged in a vertical slot 167A in the lower end of the cradle lever 166A opposite of the teeth 169A from the pivot pin 168A, as shown in FIG. 37, so as to oscillate the barrel 180A one stroke per one rotation of the cam gear 210. That is, as the cam 170A completes one rotation, the barrel 180A oscillates two cycles and the levers 140A complete one reciprocation stroke.

Figure 33:
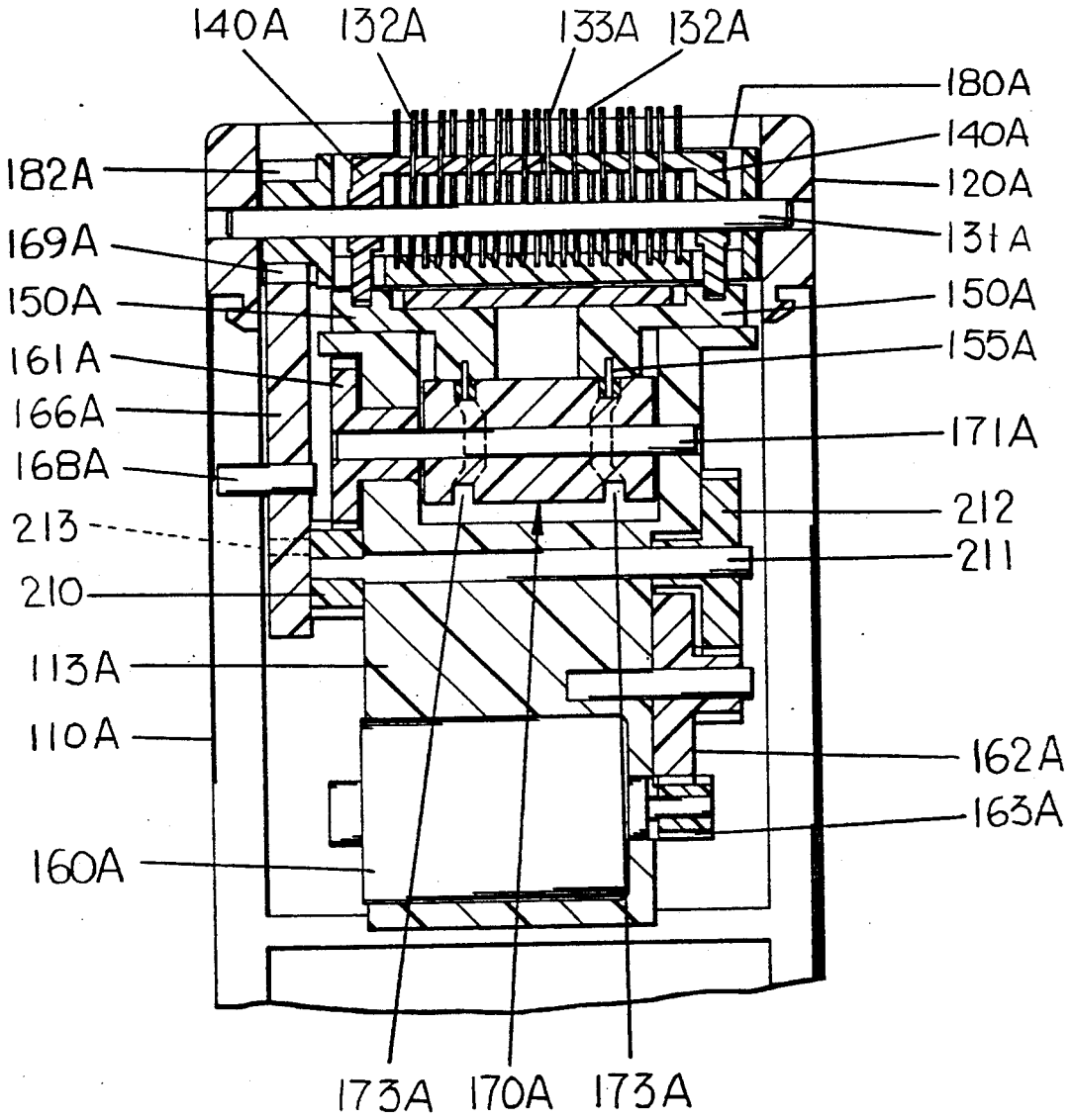
FIGS. 33 to 35 are vertical sections illustrating the operation of a depilating device in accordance with a third embodiment of the present invention.
Figure 34:
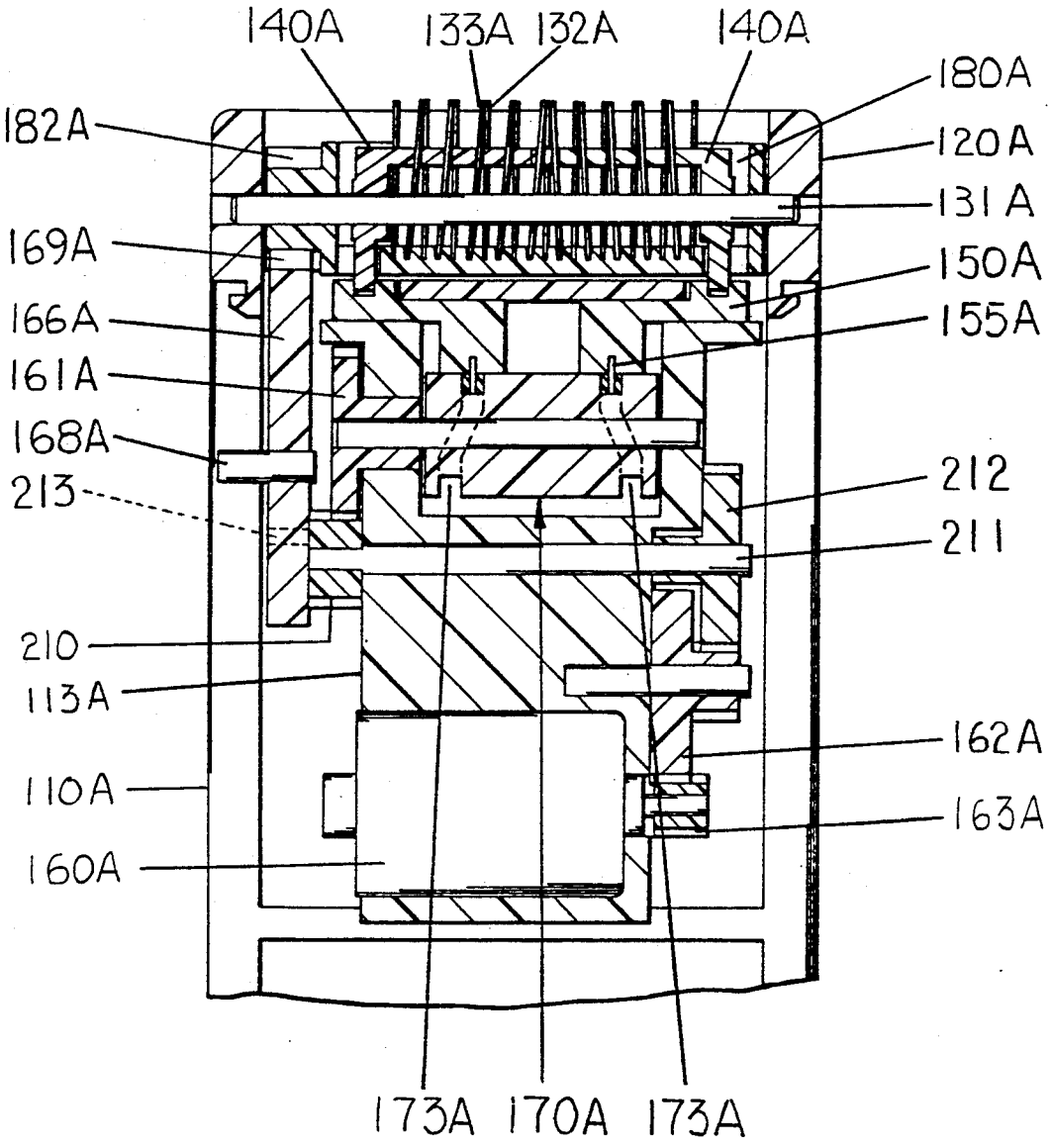
Figure 35:
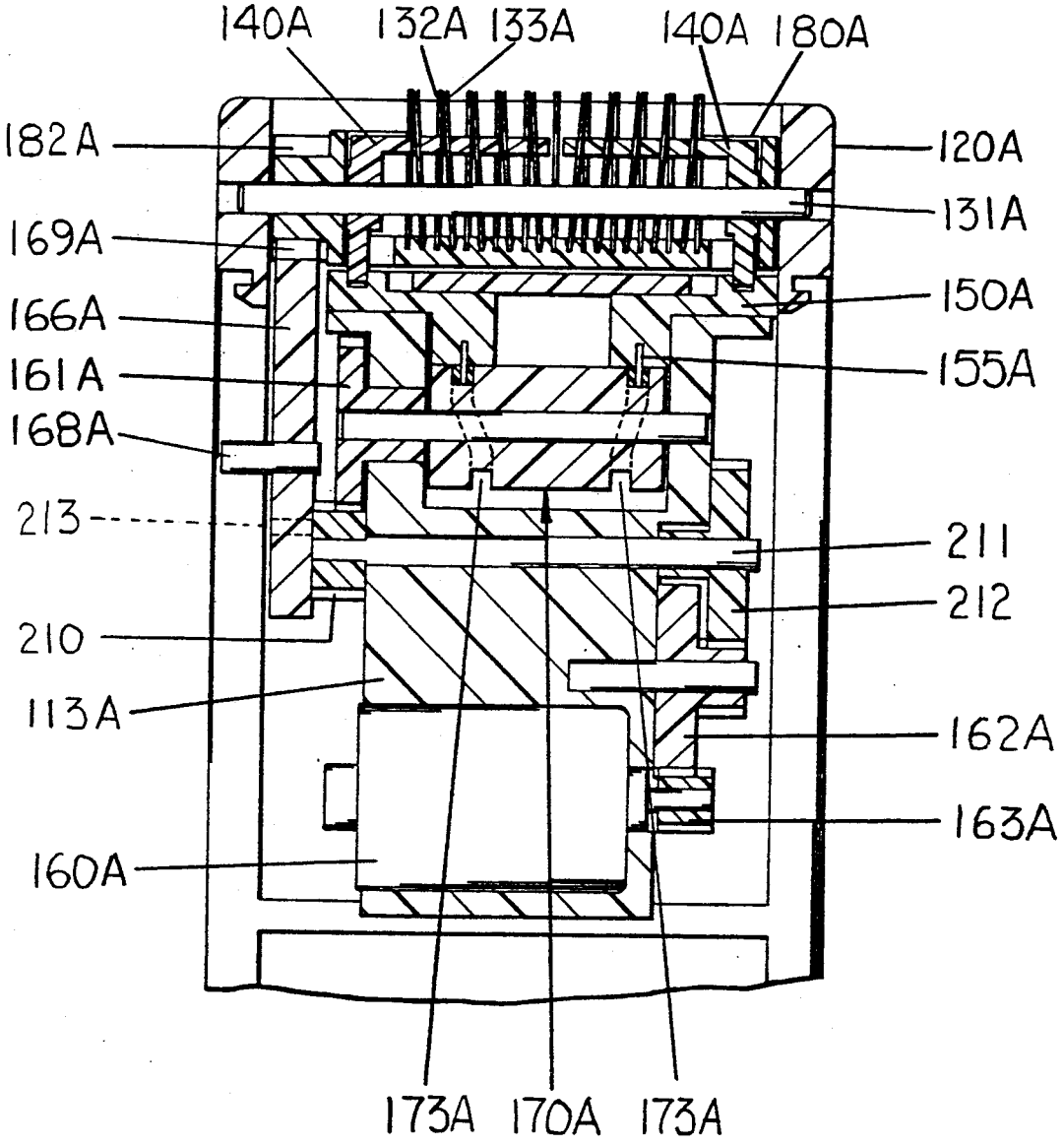
Figure 36:
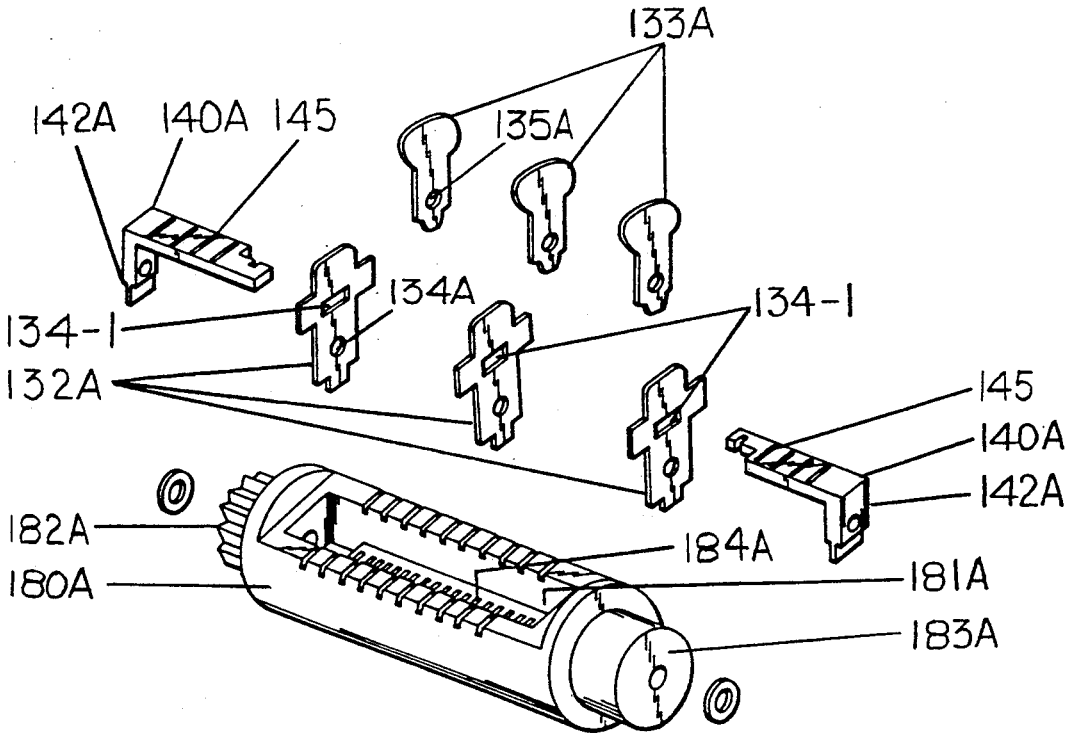
FIG. 36 is an exploded perspective view of a plucking assembly utilized in the above depilating device.
Figure 38:
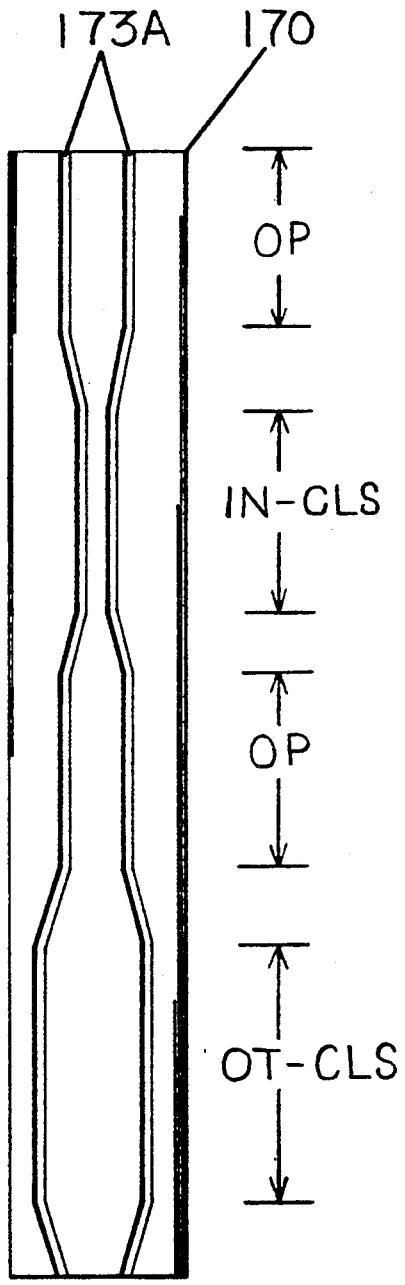
FIG. 38 is an expanded view of a positive-return cam utilized in the depilating device.

As shown in FIG. 38, the cam groove 173A is configured to have four sections extending successively through slopes in the circumferential direction, i.e. two neutral open sections OP alternated by an inward closing section IN-CLS and an outward closing section OT-CLS in which the axial distance between the grooves 173A is smaller and greater than that in the neutral open section OP, respectively. Thus, each lever 140A following each one of the grooves 173A is driven to oscillate about a neutral point so as to swing the movable plates 133A carried thereon back and forth in the axial direction of the barrel 180A, during which the movable plates 133A repeat to assume three different conditions of FIGS. 33 to 35 for successively clamping and plucking the hairs between the adjacent plates 132A and 133A. FIG. 33 shows a neutral open condition where the follower pins 155A are in the neutral open section OP of the cam grooves 173A so that the movable plates 133A are spaced away from both of the adjacent fixed plates 132A ready for introducing the hairs therebetween. As the cam 170A rotates to advance the follower pins 155A to the inward closing section IN-CLS of the grooves 173A, each of the movable plates 133A swings inwardly to be in edge contact with the inwardly adjacent fixed plate 132A, as shown in FIG. 34, for clamping the hairs therebetween. Then, the movable plates 133A are brought back into the neutral open condition of FIG. 33 as the cam 170A rotates to guide the follower pins 155A to the next neutral open section OP of the grooves 173A. This swinging movement of the movable plates 133A from FIG. 33 through FIG. 34 and back to FIG. 33 is completed in one oscillating movement of the barrel 180A about the axis of the shaft 131A. Subsequently, as the cam 170A further rotates to guide the follower pins 155A into the outward closing section OT-CLS of the grooves 173A, the movable plates 133A are caused to swing in the opposite direction to be in edge contact with the outwardly adjacent fixed plates 132A as shown in FIG. 35, thereby clamping and plucking the hairs therebetween. Thereafter, the movable plates 133A return again to the neutral condition of FIG. 33 as the follower pins 155A are guided into the neutral open section OP of the grooves 173A. Likewise, the swinging movement of the movable plates 133A from FIG. 33 through FIG. 34 and back to FIG. 35 is synchronized with next one oscillatory movement of the barrel 180A about the axis of the shaft 131A. It is noted in this connection, the barrel 180A assumes the position of FIG. 37 when the movable plates 133A swings into the clamping positions of FIGS. 34 and 35. As shown in FIG. 36, the present embodiment adopts a unique configuration for easy assembly of the movable plates 133A and the levers 140A to the barrel 180A The levers 140A are each formed with a series of slits 145 through which the corresponding movable plates 133A penetrate to have their lower ends engaged in the bottom slits 184A so that the movable plates 133A are allowed to oscillate together with the barrel 180A about the axis of the shaft 131A as well as to swing in the axial direction by the reciprocatory movement of the levers 140A. The levers 140A extends loosely through a hole 134-1 in each of the fixed plates 132A and are connected to the sliders 150A by means of the legs 142A extending through the bottom of the barrel 180A The fixed plates 132A and the movable plates 133A are formed respectively with round holes 134A and 135A for passing therethrough the shaft 131A of the barrel 180. With this arrangement, the movable plates 133A can be assembled by inserting through the individual slits 145 of the levers 140A after the fixed plates 132A and the levers 140A are assembled to the barrel 180, after which the shaft 131A is inserted through the barrel 180A, the levers 140A, the fixed plates 132A and the movable plates 133A.

What is claimed is:

1. A depilating device for removing hairs from the skin of the user which comprises:

a carrier mounting a series of first and second pinching plates which are arranged along an axis of said carrier in an alternating relation and in a closely adjacent relation to define small clearance between the adjacent first and second pinching plates for entrapping hairs therebetween;

drive means connected to drive said carrier for moving said first and second pinching plates together about said axis;

shuttle means operatively connected to at least ones of said first and second pinching plates to be movable together with said carrier about said axis, said shuttle means shiftable along said axis relative to said carrier to displace said first pinching plates relative to said second pinching plates along said axis in order to repeat clamping the hairs between the adjacent first and second pinching plates and releasing the same during the movement of said first and second pinching plates about said axis, thereby plucking the hairs from the skin and discharging the same out of said first and second pinching plates; and positive-return cam means connected to said shuttle means and caused to rotate relative to said shuttle means about a cam axis parallel, with the axis of said carrier so as to shift it along said carrier axis for displacing said first pinching plates relative to said second pinching plates, said positive-return cam means being linked to said carrier through said shuttle means and said first pinching plates in such a mutual supporting relation as to restrict the movement of said positive-return cam means and said carrier relative to each other in the direction parallel to the axis of said carrier.

2. A depilating device as set forth in claim 1, wherein said carrier is in the form of a rotary shaft driven by said drive means to rotate about said axis in one direction together with said first and second pinching plates and wherein said shuttle means comprises a set of levers spaced circumferentially about said rotary shaft and extending in parallel therewith, said levers rotatable together with said rotary shaft and operatively connected to said positive-return cam means to be shiftable along said rotary shaft in response to the rotary movement of said rotary shaft relative to said cam means for reciprocating at least ones of said first and second pinching plates along said rotary shaft.

3. A depilating device as set forth in claim 1, wherein said carrier is in the form of a barrel driven by said drive means to oscillate about an axis of said barrel defining the axis of said carrier together with said first and second pinching plates within a limited angular range and wherein said shuttle means comprises a pair of levers extending along said axis and connected to at least said first pinching plates, said levers connected said barrel to oscillate together therewith and operatively connected to said positive-return cam means so as to be shiftable along said axis in response to the oscillatory movement of said barrel relative to said cam means for reciprocating at least ones of said first and second pinching plates along said barrel axis.

4. A depilating device as set forth in claim 1, wherein each of said first pinching plates are connected to said shuttle means to be displaced relative to the adjacent said second pinching plate in such a manner as to move one end of each first pinching plate into edge contact with one of said adjacent second pinching plates while spacing the opposite end of each first pinching plate away from that adjacent second pinching plate so that said first pinching plate swings with respect to a plane normal to said carrier axis about a fulcrum point located opposite of said contacting edge from said carrier axis.

5. A depilating device as set forth in claim 4, wherein said first pinching plate is connected to said shuttle means at a force point intermediate between said contacting edge and the axis of said carrier so that said fist pinching plate swings by a force applied to said force point from said cam means.

6. A depilating device as set forth in claim 1, wherein said first pinching plates are movable plates supported on said carrier to be capable of swinging with respect to a plane normal to said carrier axis and said second pinching plates are fixed plates supported on said carrier to be fixed thereto in the axial direction of said carrier.

7. A depilating device as set forth in claim 1, wherein at least ones of said first and second pinching plates are made of shock-absorbing plates.

8. A depilating device as set forth in claim 1, wherein said first and second pinching plates are arranged such that some pairs of first and second pinching plates come into a closed condition of plucking the hairs therebetween in a delayed fashion from the other pairs of said first and second pinching plates as said carrier is driven to move about said carrier axis.

9. A depilating device as set forth in claim 1, further including a trimmer comprising a stationary blade and a movable blade which are in hair shearing engagement along a line parallel to said carrier axis, said stationary blade has an edge projecting beyond a complementary cutting edge of said movable blade for contact with the skin of the user in such a manner as to position the cutting edge of said movable blade away from the skin.

10. A depilating device as set forth in claim 6, wherein said shuttle means comprises at least one pair of levers each connected to each half number of said movable blades for displacing said movable blades relative to said fixed plates, said levers in a pair reciprocating along said carrier axis in the opposite directions to effect dynamic balancing for the movement of said movable blades and said levers.

* * * * *